US005219236A

United States Patent [19]

Kamimura et al.

[11] Patent Number: 5,219,236

[45] Date of Patent: Jun. 15, 1993

[54] RECORDING APPARATUS CAPABLE OF RECORDING INFORMATION ON BOTH A CONTINUOUS RECORDING MEDIUM AND A CUT-SHEET RECORDING MEDIUM

[75] Inventors: Masahiro Kamimura; Naokazu Shimoda; Eiji Tanaka; Akehiro Ono, all of Nagoya, Japan

[73] Assignee: Brother Kogyo Kabushiki Kaisha, Nagoya, Japan

[21] Appl. No.: 643,282

[22] Filed: Jan. 22, 1991

Related U.S. Application Data

[63] Continuation of Ser. No. 321,287, Mar. 9, 1989, abandoned.

[30] Foreign Application Priority Data

Mar. 11, 1988 [JP] Japan ..... 63-58960
Mar. 12, 1988 [JP] Japan ..... 63-58893
Mar. 14, 1988 [JP] Japan ..... 63-59860

[51] Int. Cl.[5] ..... B41J 11/50

[52] U.S. Cl. ..... 400/605; 400/607.2; 400/599; 400/693

[58] Field of Search ..... 400/355, 356, 357, 358, 400/599, 600, 600.1, 600.2, 600.3, 605, 607, 607.2, 608, 608.1, 608.2, 608.4, 611, 613, 613.1, 636, 636.1, 636.2, 637.1, 639.1, 648, 649, 619, 691, 692, 693; 346/135, 146

[56] References Cited

U.S. PATENT DOCUMENTS

| | | | |
|---|---|---|---|
| 1,302,460 | 4/1919 | Wheaton | 400/649 |
| 3,216,021 | 11/1965 | Stefansson | 346/136 |
| 3,519,213 | 7/1970 | Hofmann et al. | 242/57 |
| 3,644,930 | 2/1972 | Stange et al. | 346/145 |
| 3,717,881 | 2/1973 | Bunning | 346/136 |
| 3,905,462 | 9/1975 | Nowak | 400/613 |
| 4,079,826 | 3/1978 | Shaw | 400/613 |
| 4,205,770 | 6/1980 | Wojdyla | 400/608.1 |
| 4,223,325 | 9/1980 | Ebert | 346/136 |
| 4,229,113 | 10/1980 | Anderson et al. | 400/596 |
| 4,348,125 | 9/1982 | Fujiwara et al. | 400/605 |
| 4,417,517 | 11/1983 | Matsuda et al. | 400/584 |
| 4,425,047 | 1/1984 | Narushima | 400/605 |
| 4,589,784 | 5/1986 | Valle et al. | 400/596 |
| 4,636,100 | 1/1987 | Fujisawa | 346/136 |
| 4,639,154 | 10/1987 | Myers | 400/600.2 |
| 4,663,638 | 5/1987 | Hirose | 346/136 |
| 4,941,015 | 7/1990 | Komai et al. | 346/145 |

FOREIGN PATENT DOCUMENTS

| | | | |
|---|---|---|---|
| 3232875 | 3/1984 | Fed. Rep. of Germany | 400/585 |
| 3524697 | 1/1987 | Fed. Rep. of Germany | 400/585 |
| 95821 | 7/1980 | Japan | 346/145 |
| 150583 | 11/1981 | Japan | 400/600.2 |
| 165668 | 9/1984 | Japan . | |
| 155482 | 8/1985 | Japan . | |
| 202869 | 9/1986 | Japan | 400/636 |
| 242863 | 10/1986 | Japan | 400/690.4 |

*Primary Examiner*—David A. Weicking
*Attorney, Agent, or Firm*—Oliff & Berridge

[57] ABSTRACT

A recording apparatus for recording information on a continuous rolled recording medium, said recording apparatus comprising a fixed unit and a movable unit. The continuous rolled recording medium is exchangeable in the open position of said movable unit. A printing head is located in either of said fixed unit or said movable unit and a platen is located in the remaining unit. A pair of feed rollers are located downstream of said printing head and said platen with respect to a feeding direction of said recording medium. One of said feed rollers located in said fixed unit is displaceable between a contact position contacting with the other feed roller located in said movable unit when said movable unit is in the closed position and a release position separate from the other feed roller outside a locus of an outer profile of said movable unit. When said movable unit is closed an end portion of said continuous rolled recording medium can be set between said printing head and said platen and between said pair of feed rollers.

13 Claims, 22 Drawing Sheets

RECORDING APPARATUS CAPABLE OF RECORDING INFORMATION ON BOTH A CONTINUOUS RECORDING MEDIUM AND A CUT-SHEET RECORDING MEDIUM

This is a continuation of application Ser. No. 07/321,287 filed Mar. 9, 1989, now abandoned.

BACKGROUND OF THE INVENTION

The present invention relates to a recording apparatus capable of recording information on both a continuous recording medium and a cut-sheet recording medium, and more particularly to an improvement in such a recording apparatus which may simplify the exchanging and resetting of a continuous rolled recording medium and also may easily set a cut-sheet recording medium.

In a conventional recording apparatus for recording information on the continuous rolled recording medium, either of a printing head or a platen is provided in a fixed unit of the recording apparatus, and the other is provided in a movable unit rotatable relative to the fixed unit. In the case that the platen does not serve to feed the recording medium, a pair of feed rollers are further provided in the recording apparatus, one of the feed rollers being located in the fixed unit and the other feed roller being located in the movable unit. Under the open condition of the movable unit, the recording medium can be exchanged, and under the closed condition, an unrolled portion of the continuous rolled recording medium is set between the printing head and the platen. In the case that the pair of feed rollers are further provided, the unrolled portion of the continuous rolled recording medium is set between the feed rollers. Thus, a ready condition for printing and paper feeding is reset. Such recording apparatus is disclosed in U.S. Pat. Nos. 3,644,930, 3,905,462 and 4,223,325, for example.

Another type recording apparatus capable of recording information on a cut-sheet recording medium as well as a continuous rolled recording medium is disclosed in Japanese Patent Laid-Open Publication Nos. 59-165668 and 60-155482, for example.

However, the recording apparatus including both a paper feeding mechanism for feeding the continuous rolled recording medium and another paper feeding mechanism for feeding the cut-sheet recording medium has a shortcoming such that the rotation of the movable unit interferes with the paper feeding mechanisms. Further, the pair of feed rollers are located upstream of the position where the printing head and the platen are opposed, so as not to interfere with the insertion of the cut-sheet recording medium between the printing head and the platen. However, in this case, there is a problem that the continuous rolled recording medium is slacked at any position downstream of the feed rollers. Such slack tends to occur especially in the case that the recording medium is fed upwardly. When the slack of the recording medium is generated, proper printing cannot be performed. That is, a proper line spacing of data to be printed cannot be ensured. Especially when the slack is generated between the printing head and the platen, a printing stylus of the printing head will be caught by the slacked portion of the recording medium, causing breakage of the recording medium.

SUMMARY OF THE INVENTION

It is an object of the present invention to provide a recording apparatus which may simplify the exchanging and setting operations of the continuous rolled recording medium.

It is another object of the present invention to provide a recording apparatus which may eliminate the slack and wrinkle of the continuous rolled recording medium during feeding thereof and upon exchanging and setting thereof.

It is a further object of the present invention to provide a recording apparatus which may record information on both a continuous rolled recording medium and a cut-sheet recording medium.

According to a first aspect of the present invention, there is provided a recording apparatus for recording information on a continuous rolled recording medium, said recording apparatus comprising a fixed unit; a movable unit adapted to be pivotably moved relative to said fixed unit between an open position and a closed position, said continuous rolled recording medium being exchangeable in said open position of said movable unit; a printing head located in either of said fixed unit or said movable unit; a platen located in the remaining of said fixed unit or said movable unit, said platen being opposed to said printing head when said movable unit is in the closed position; and a pair of feed rollers for feeding said continuous rolled recording medium, said feed rollers being located downstream of said printing head and said platen with respect to a feeding direction of said recording medium, said feed rollers comprising a drive roller located in either of said fixed unit or said movable unit and a driven roller located in the remaining of said fixed unit or said movable unit, one of said feed rollers located in said fixed unit being displaceable between a contact position contacting with the other feed roller located in said movable unit when said movable unit is in the closed position and a release position separate from the other feed roller outside a locus of an outer profile of said movable unit, whereby when said movable unit is closed under the condition where one end portion of said continuous rolled recording medium is unrolled and extended along an outer periphery of said feed roller located in said movable unit, said one end portion of said continuous rolled recording medium can be set between said printing head and said platen and between said pair of feed rollers.

According to a second aspect of the present invention, there is provided a recording apparatus for recording information on a continuous rolled recording medium, comprising a fixed unit having a receiving portion for receiving said recording medium; a movable unit adapted to be pivotably moved relative to said fixed unit between a closed position and an open position, wherein when said movable unit is in the closed position, said recording medium is covered by said movable unit, while when said movable unit is in the open position, said recording medium received in said receiving portion is exchangeable; a printing head; a platen adapted to be located in opposed relationship to said printing head; and a take-up roller for winding said recording medium after printing, said take-up roller being rotatable in opposite directions in association with pivotal movement of said movable unit.

According to a third aspect of the present invention, there is provided a recording apparatus for recording information on both a continuous rolled recording medium and a cut-sheet recording medium, said recording apparatus comprising a fixed unit; a movable unit adapted to be moved relative to said fixed unit between an open position and a closed position, said continuous rolled recording medium being exchangeable in said open position of said movable unit; a printing head located in either of said fixed unit or said movable unit; a platen located in the remaining of said fixed unit or said movable unit in such a manner that a gap for permitting insertion of said cut-sheet recording medium is defined between said printing head and said platen when said movable unit is in said closed position; and a pair of feed rollers for feeding said continuous rolled recording medium, said feed rollers comprising a drive roller located in either of said fixed unit or said movable unit and a driven roller located in the remaining of said fixed unit or said movable unit, one of said feed rollers located in said fixed unit being displaceable between a contact position contacting with the other feed roller located in said movable unit when said movable unit is in the closed position and a release position separate from the other feed roller outside a locus of an outer profile of said movable unit, said pair of feed rollers being located at a position apart from an extension of said gap between said printing head and said platen when said movable unit is in the closed position, whereby said cut-sheet recording medium can be inserted into said gap without being hindered by said pair of feed rollers when said movable unit is in the closed position, and said movable unit can be moved without being hindered by said feed roller located in said fixed unit, and when said movable unit is closed under the condition where one end portion of said continuous rolled recording medium is unrolled and extended along an outer periphery of said feed roller located in said movable unit, said one end portion of said continuous rolled recording medium can be set between said printing head and said platen and between said pair of feed rollers.

The basic idea of the present invention is schematically shown in FIG. 1. Referring to FIG. 1, reference characters A and B denote a platen and a printing head (and vice versa). A continuous rolled recording medium P or a cut-sheet recording medium F is inserted between the platen A (B) and the printing head B (A), and information is printed on the recording medium P or F. An unrolled portion of the continuous rolled recording medium P is inserted between a pair of feed rollers C and D and is fed by the feed rolers C and D under the contact condition. The platen (or the printing head) A and the feed roller C are provided in a movable (rotatable) unit H, while the printing head (or the platen) B and the feed roller D are provided in a fixed unit I. The movable unit H is rotatable about an axis E in a direction of arrow X and is opened relative to the fixed unit I. Reference character G denotes a locus of the outer periphery of the movable unit H during the rotation thereof. When the movable unit H is opened, the feed roller D is retracted to a position D' outside the locus G, while when the movable unit 12 is closed, the feed roller D' is returned to the position D to contact the feed roller C. In printing information on the cut-sheet recording medium F, the feed roller D is located on the one side (right side as viewed in FIG. 1) of the recording medium F, so as not to hinder insertion of the recording medium F into the gap between the platen (the printing head) A and the printing head (the platen) B.

The invention will be more fully understood from the following detailed description and appended claims when taken with the drawings.

DETAILED DESCRIPTION OF THE PREFERRED EMBODIMENTS

Figure 1:
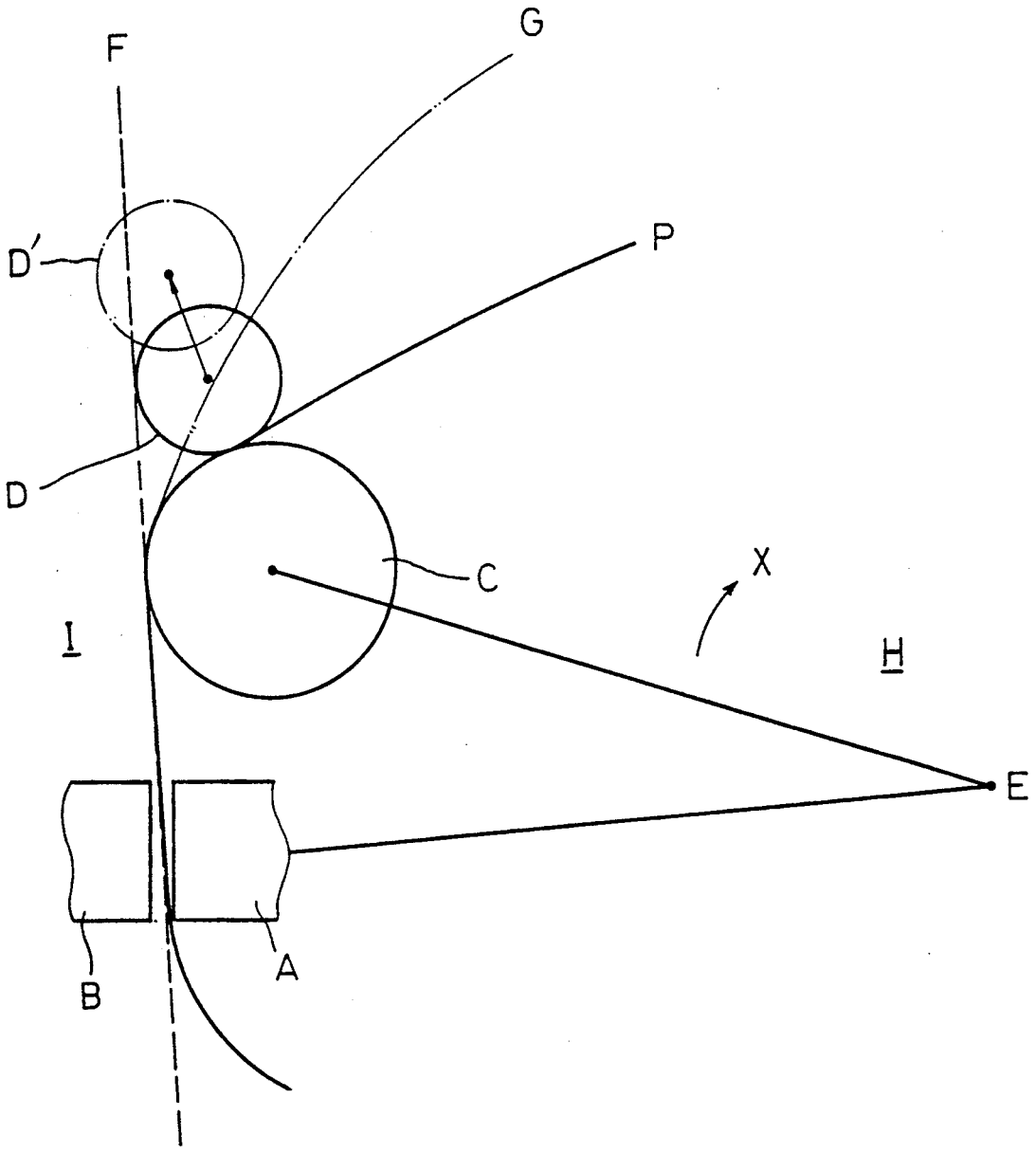
FIG. 1 is a schematic illustration of the basic idea of the present invention.

Referring now to FIGS. 2 to 15 which show a first preferred embodiment of the present invention, reference numeral 1 generally designates a printer for use with a register. The printer 1 is generally constructed of a fixed unit 2 and a movable unit 12. A body frame 3 of the fixed unit 2 is provided at its rear portion (right portion as viewed in FIGS. 2 to 4) with a paper holder 4. The paper holder 4 is provided with right and left paper receiving portions 5 partitioned by a central wall **4*b* for receiving a receipt paper P1 and a journal paper P2 both in the form of a roll. A guide plate 6 extend from the paper holder 4 toward a printing head 8 so as to guide a leading end portion of the roller papers P1 and P2 received in the paper receiving portions 5. The receipt paper P1 after printing information is cut and supplied to a customer, while the journal paper P2 after printing the same information is wound around a take-up roller located in the movable unit 12** to be hereinafter described.

Figure 4:
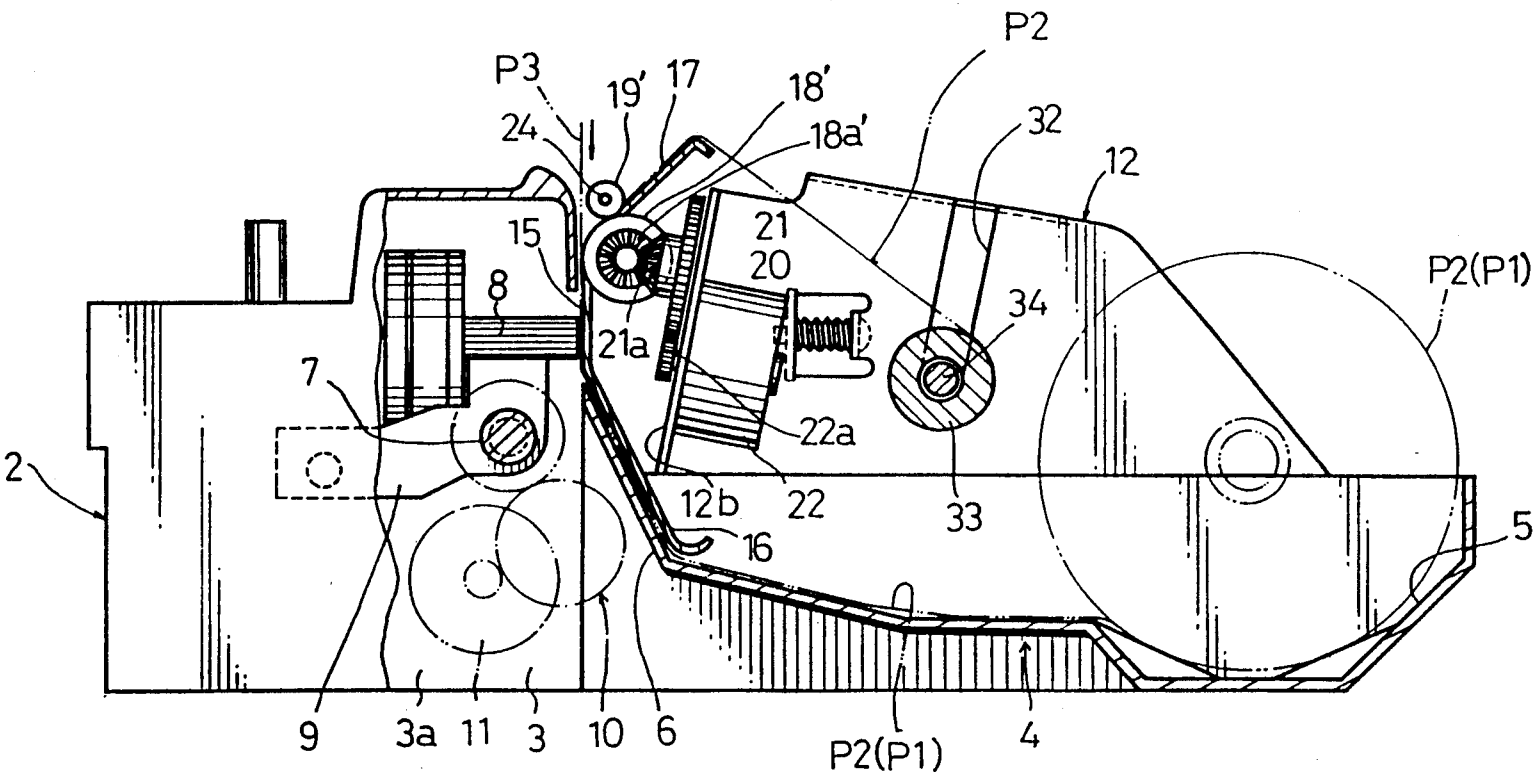
FIG. 4 is a sectional side view of FIG. 2.

A feed cam shaft 7 is rotatably mounted to right and left side walls 3*a* of the body frame 3, and a carriage 9 mounting the printing head 8 thereon is axially movably mounted on the feed cam shaft 7. The feed cam shaft 7 is formed with a cam groove engaging with a slider projecting from an inner circumference of a mounting hole of the carriage 9, so that when the feed cam shaft 7 is rotated, the carriage 9 is axially moved. As shown in FIG. 4, the feed cam shaft 7 is operatively connected through a gear train 10 to a carriage driving motor 11.

Figure 2:
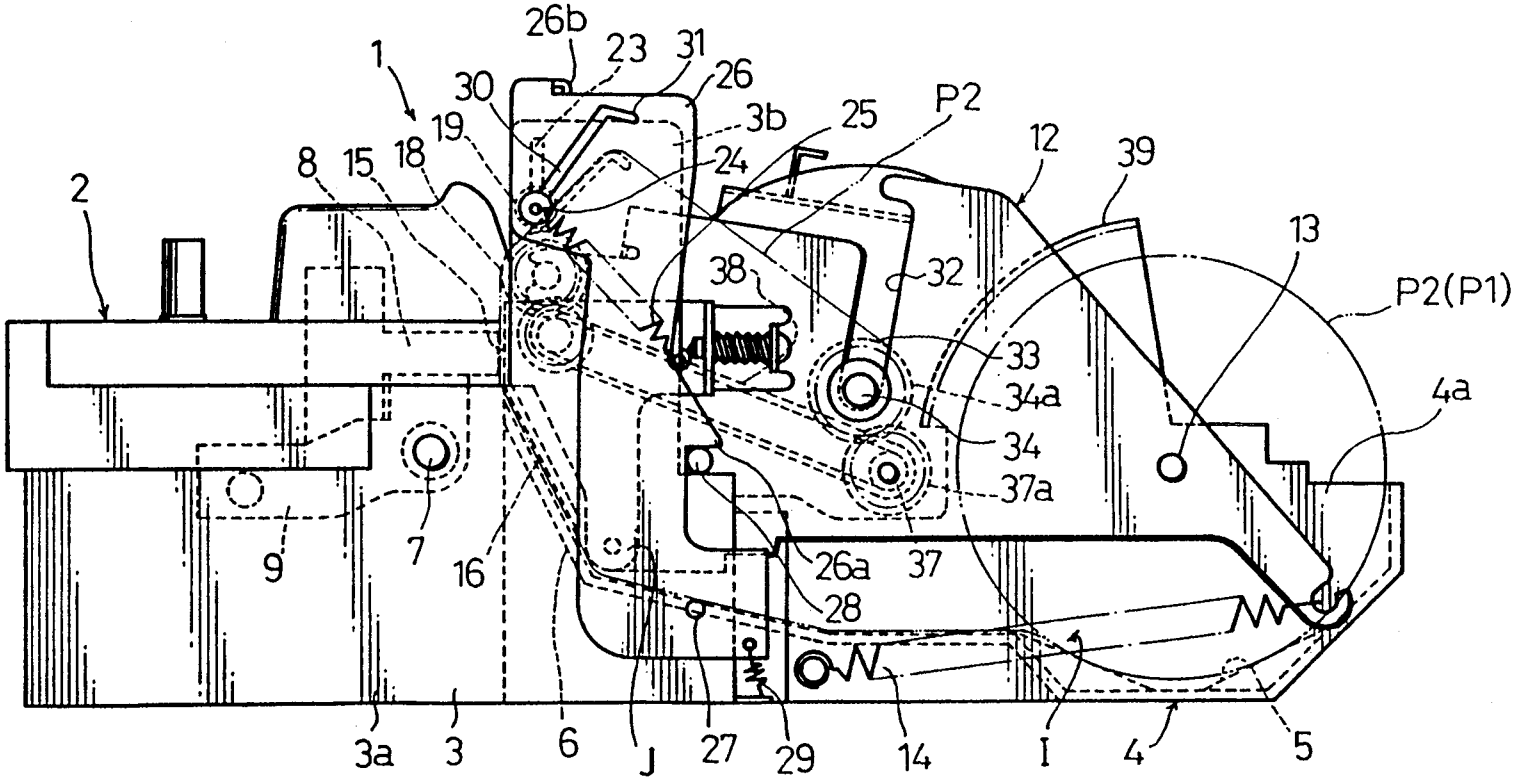
FIG. 2 is a side elevational view of the recording apparatus of a first preferred embodiment according to the present invention.

The movable unit 12 is pivotably supported to a pair of pins 13 fixed to right and left side walls 12*a* of the movable unit 12, and is normally biased by a pair of tensile springs 14 in an opening direction of the movable unit 12 (in the clockwise direction as viewed in FIG. 2). A plate-like platen 15 is located at the left end of the side walls 12*a* of the movable unit 12 at a position where the platen 15 is opposed to the printing head 8 under the closed condition of the movable unit 12. A pair of guide plates 16 and 17 extend downwardly and upwardly from the platen 15, respectively, so as to guide the leading end portion of the roller papers P1 and P2. The lower guide plate 16 of the platen 15 is opposed to the guide plate 6 of the paper holder 4 to define a paper feeding passage therebetween.

Figure 3:
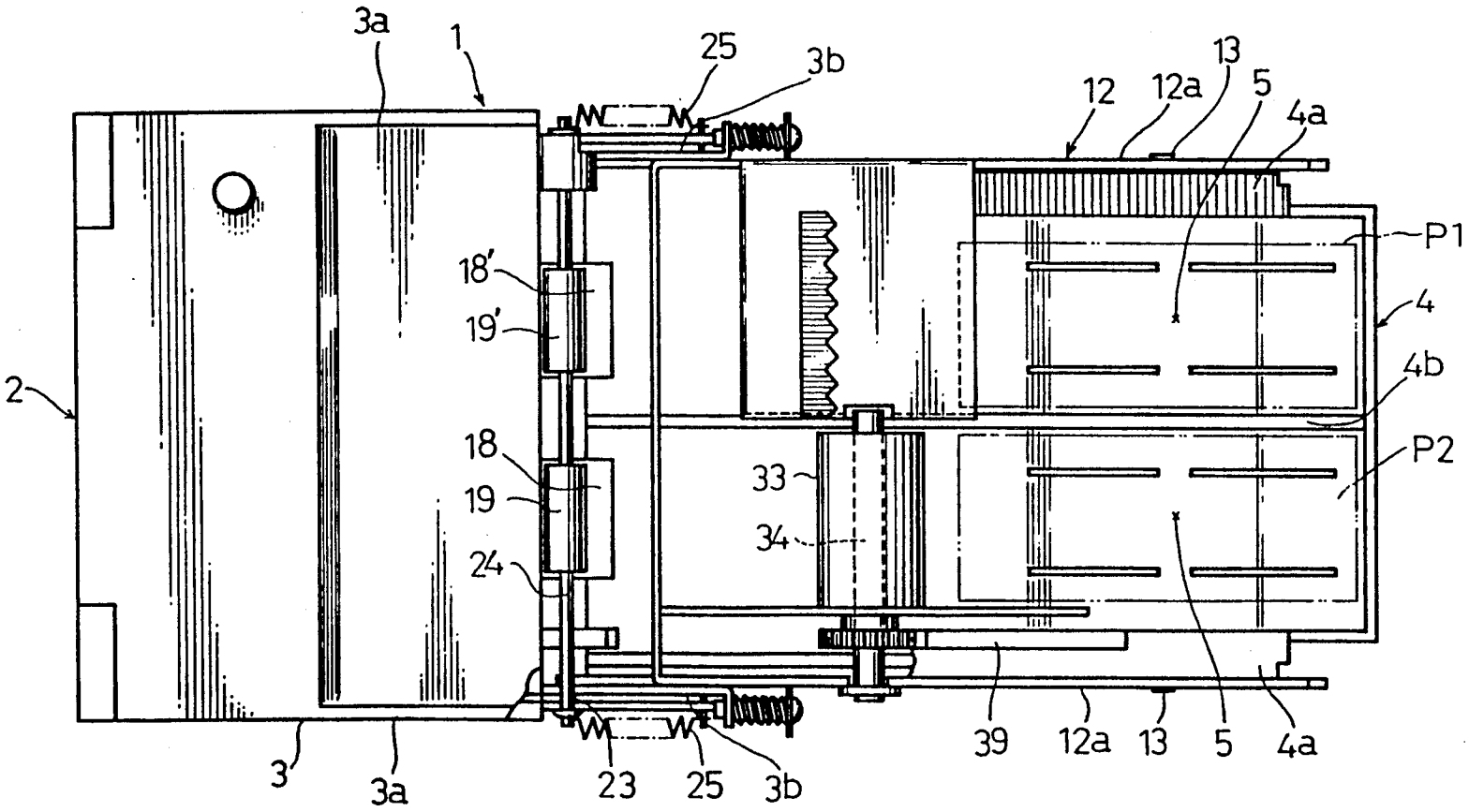
FIG. 3 is a plan view of FIG. 2.

As shown in FIGS. 3 and 4, a pair of right and left drive rollers 18' and 18 for feeding the roller papers P1 and P2, respectively, are provided at a downstream side of the platen 15, and a pair of right and left driven rollers 19' and 19 are provided over the drive rollers 18' and 18, respectively. The drive rollers 18' and 18 and the driven rollers 19' and 19 are so positioned as to be offset from an extension of a gap defined between the printing head 8 and the platen 15, so that a cut-sheet paper P3 (validation paper, slip paper, etc.) may be inserted into the gap without being hindered by the drive rollers 18' and 18 and the driven rollers 19' and 19.

Figure 5:
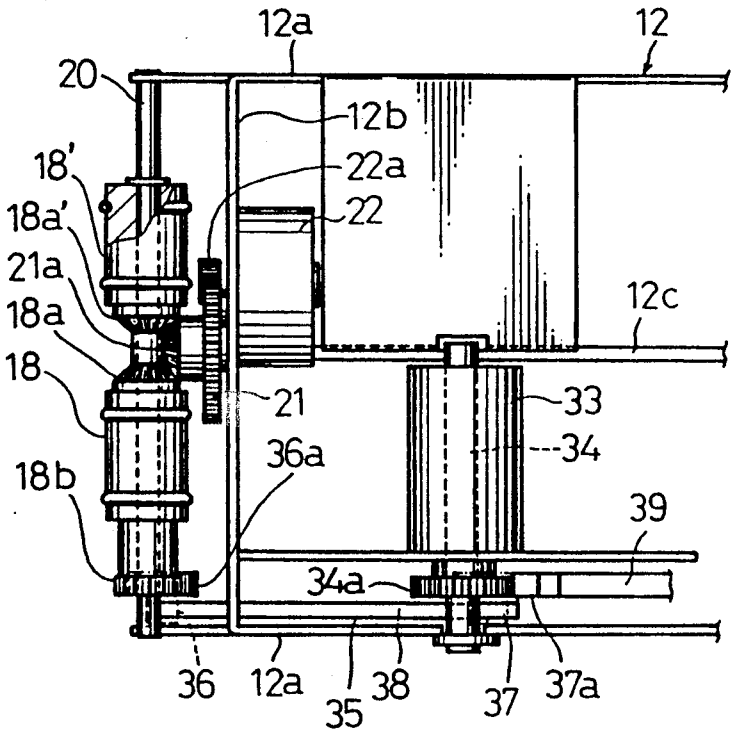
FIG. 5 is a plan view of a driving mechanism for paper feed in FIG. 2.

As shown in FIG. 5, a roller shaft 20 is mounted to the right and left side walls 12*a* of the movable unit 12, and the right and left drive rollers 18' and 18 for feeding the rolled papers P1 and P2 are rotatably mounted on the roller shaft 20. As shown in FIG. 4, portions of the drive rollers 18' and 18 are exposed from openings defined between the platen 15 and the upper guide plate 17. As shown in FIG. 5, both the drive rollers 18' and 18 are formed at their opposed side surfaces with a pair of bevel gears 18*a'* and 18*a* meshing with a bevel gear 20*a* integrally formed with a drive gear 21. The drive gear 21 meshes an output gear 22*a* of a reversible motor (stepping motor) 22. The motor 22 is mounted to a connecting frame 12*b* connecting both the side walls 12*a* of the movable unit 12. A one-way clutch (not shown) is provided between the drive roller 18' and the bevel gear 18*a'*, and another one-way clutch (not shown) is provided between the drive roller 18 and the bevel gear 18*a*, so that when the motor 22 is rotated in one direction, one of the drive rollers 18' and 18 is permitted to be rotated through the corresponding one-way clutch in a paper feeding direction, while when the motor 22 is rotated in the other direction, the other drive roller is permitted to be rotated through the corresponding one-way clutch in the paper feeding direction.

Figure 6:
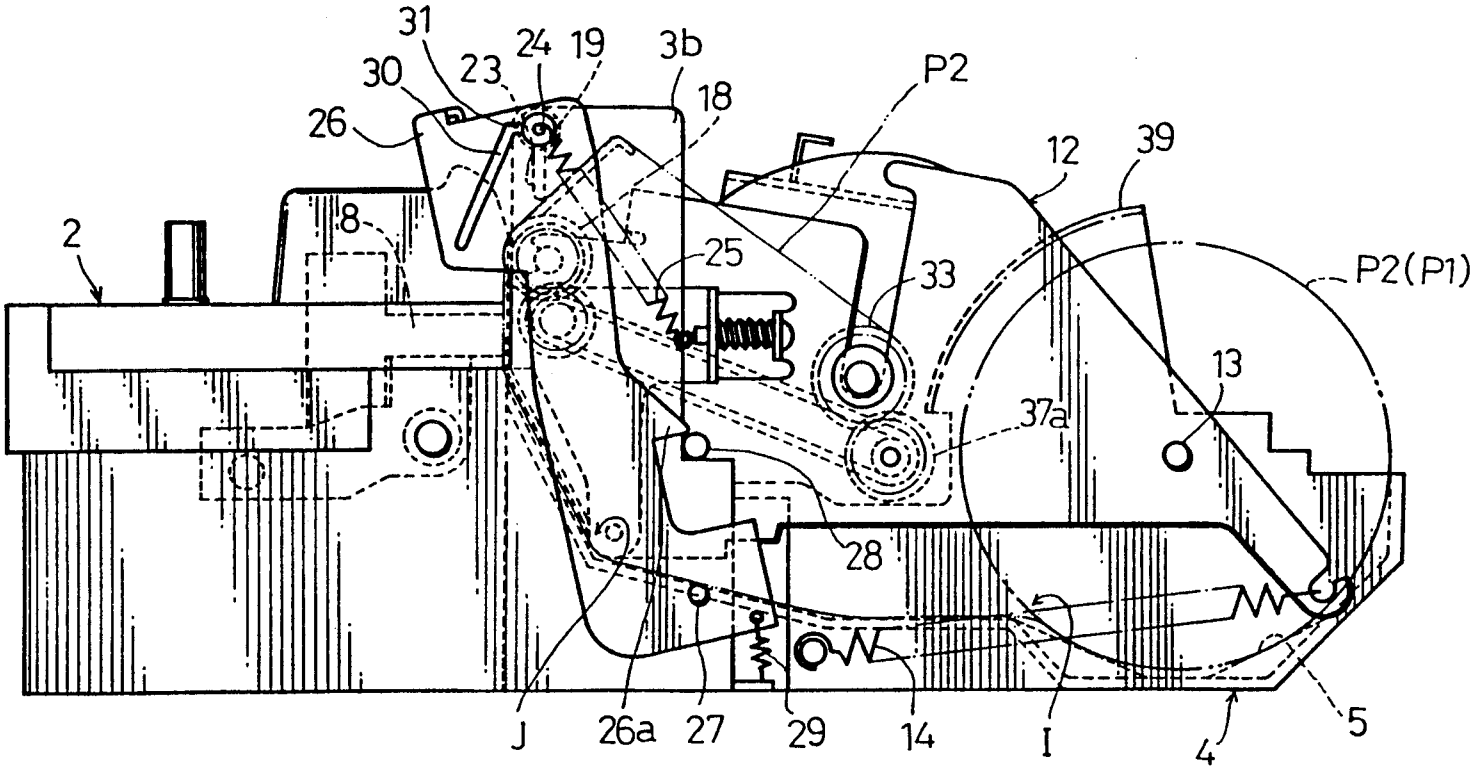
FIG. 6 is a view similar to FIG. 2 under the condition where a lock lever is pivoted to an unlocking position.

As shown in FIGS. 2 and 6, a pair of right and left support walls 3*b* extend upwardly from a rear end portion of the side walls 3*a* of the body frame 3. The support walls 3*b* are formed with a pair of vertically elongated holes 23 for vertically movably supporting a driven roller shaft 24 rotatably mounting the right and left driven rollers 19' and 19 thereon. The driven rollers 19' and 19 are mounted on the driven roller shaft 24 are normally biased by a pair of springs 25 to a lower position of the elongated holes 23 where the driven rollers 19' and 19 contact the drive rollers 18' and 18 with the papers P1 and P2 interposed therebetween, respectively. In an upper position or a retracted position of the driven rollers 19' and 19 with the driven roller shaft 24 in the elongated holes 23, the driven rollers 19' and 19 are retracted outside a locus of an outer profile of the movable unit 12 so as not to hinder the pivotal movement of the movable unit 12.

A pair of right and left lock levers 26 are pivotably mounted to the right and left side walls 3*a* of the body frame 3 about a pair of support pins 27 fixed at a lower position of the side walls 3*a*. The lock levers 26 operate to releaseably lock the movable unit 12 at the closed position. The lock levers 26 are formed with a pair of lock pawls 26*a* adapted to releaseably engage a pair of lock pins 28 projecting outwardly from the side walls 12*a* of the movable unit 12. The lock levers 26 are normally biased by a pair of tensile coil springs 29 to engage the lock pawls 26*a* with the lock pins 28. The lock levers 26 extend upwardly along the support walls 3*b* of the body frame 3 to a position higher than the support walls 3*b* by a predetermined height. The lock levers 26 are formed at its upper portion with an operating member 26*b* for rotating the lock levers 26 in an unlocking direction thereof.

When the lock levers 26 are moved to the lock position, the driven rollers 19' and 19 are moved to the paper feeding position or the contact position contacting the drive rollers 18' and 18, while when the lock levers 26 are moved to the unlock position, the driven rollers 19' and 19 are moved to the retracted position. That is, the lock levers 26 are formed at their upper portion with a pair of elongated cam holes 30 engaging the opposite ends of the driven roller shaft 24. The cam holes 30 extend obliquely straight or curvedly in such a manner that a distance from the support pins 27 gradually increase from the lower end to the upper end of the cam holes 30. When the lock levers 26 are in the lock position, the driven roller shaft 24 is located at the lower end of the cam holes 30, and the driven rollers 19' and 19 are located at the paper feeding position. On the other hand, when the lock levers 26 are rotated in the unlocking direction (in the clockwise direction as viewed in FIG. 2), the driven roller shaft 24 is urged upwardly by a cam surface of the cam holes 30 to move upwardly along the elongated holes 23 of the body frame 3. When the lock levers 26 are brought into the unlock position, the driven rollers 19' and 19 are located at the retracted position.

The lock levers 26 are further formed with a pair of stopper holes 31 continuously extending from the upper end of the cam holes 30 in such a manner as to be inclined downwardly. With this arrangement, when the lock levers 26 are rotated to the unlock position as shown in FIG. 6, they are retained in the stopper holes 31 against the biasing force of the springs 29. Accordingly, the driven rollers 19' and 19 are retained at the retracted position against the biasing force of the springs 25.

As shown in FIGS. 2 and 5, one of the side walls 12*a* and a central wall 12*c* of the movable unit 12 are formed with a pair of upside opened cutouts for rotatably supporting a roller shaft 34. The roller shaft 34 is releaseably mounted in the cutouts 32. A single take-up roller 33 is frictionally supported on the roller shaft 34 for winding up the leading end portion of the journal paper P2 fed out from between the drive roller 18 and the driven roller 19. The take-up roller 33 is operatively connected through a belt drive mechanism 35 to one of the drive rollers 18' and 18. The belt drive mechanism 35 includes a drive pulley 36 and a driven pulley 37 both rotatably provided on the inside of the side wall 12*a* of the movable unit 12 and an endless belt 38 wound around both the drive and driven pulleys 36 and 37. The drive pulley 36 is formed with a gear 36*a* meshing with a gear 18*b* fixedly mounted on the drive roller shaft 20. The driven pulley 37 is formed with a gear 37*a* meshing with a gear 34*a* fixedly mounted on the take-up roller shaft 34. In feeding the journal paper P2, the drive roller 18 is driven by the motor 22, and the torque of the drive roller 18 is transmitted through the belt drive mechanism 35 to the roller shaft 34. The torque transmitted to the roller shaft 34 is transmitted to the take-up roller 33 within a set frictional force between the roller shaft 34 and the take-up roller 33. Thus, the leading end portion of the journal paper P2 in an amount corresponding to a paper feed quantity by the drive roller 18 is wound up by the take-up roller 33. The take-up roller 33 is positioned near the unused roll paper P2 to such a degree that the outer circumference of the paper wound around the take-up roller 33 is restrained from contacting the outer circumference of the roll paper P2 received in the paper receiving portion 5.

Figure 7:
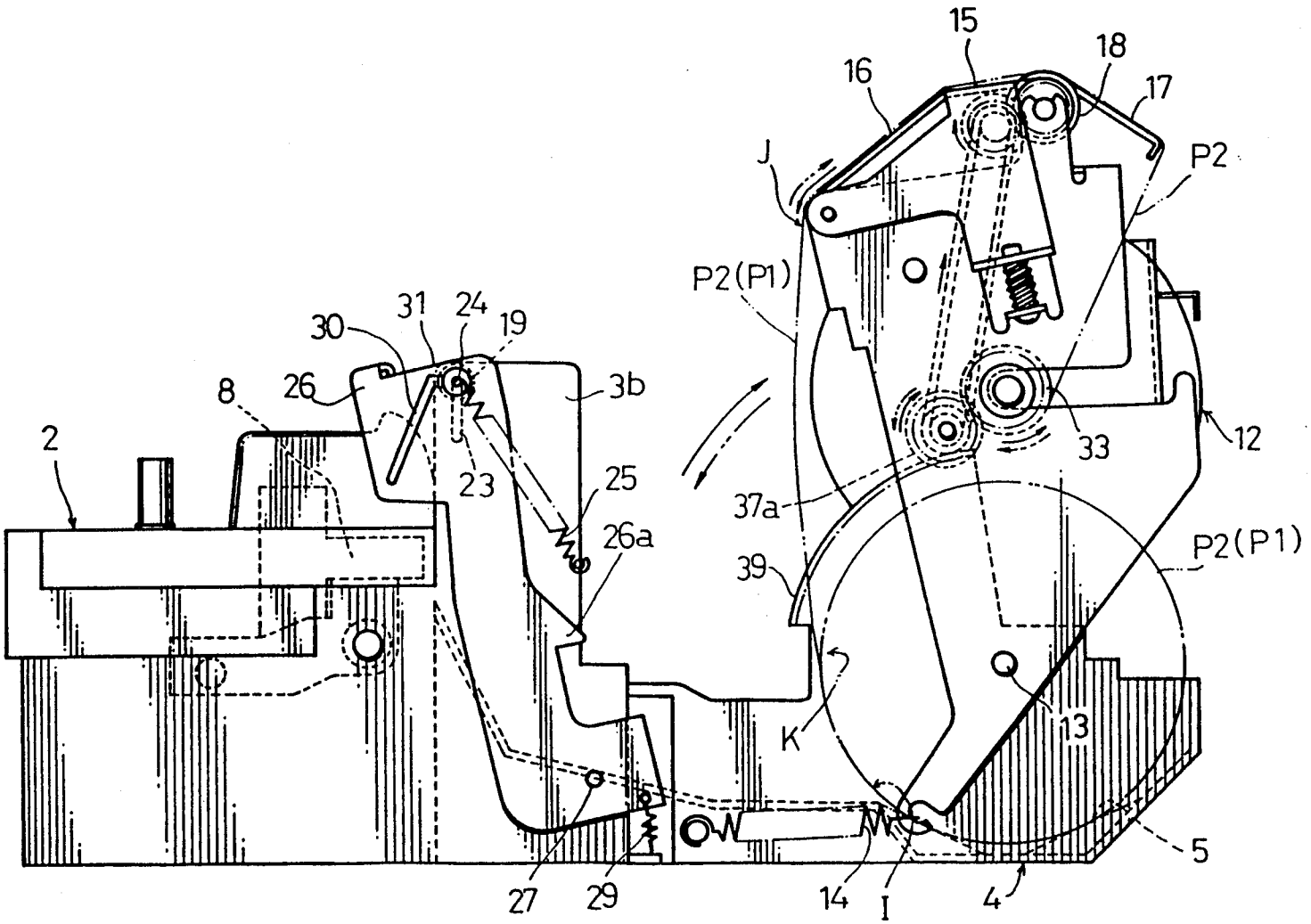
FIG. 7 is a view similar to FIG. 2 under the condition where the movable unit is in the open position.

As shown in FIGS. 2, 6 and 7, one of the side walls 4*a* of the paper holder 4 is formed at its outer periphery with a sector gear 39 forming an arc about the support pin 13 on the side wall 4*a* side. The sector gear 39 is adapted to disengageably mesh with the gear 37*a* of the driven pulley 37 of the belt drive mechanism 35. When the movable unit 12 is in the closed position, the sector gear 39 is out of meshing with the gear 37*a* as shown in FIG. 2, while when the movable unit 12 is opened by a predetermined amount from the closed position, the gear 37*a* comes into meshing with the sector gear 39. When the movable unit 12 is further opened, the gear 37*a* of the driven pulley 37 is rotated to rotate the gear 34*a* and accordingly rotate the roller shaft 34 of the take-up roller 33 in a paper unwinding direction. Reversely, when the movable unit 12 is closed from the open position, the take-up roller 33 is rotated in a paper winding direction through the gears 39, 37*a* and 34*a*.

Comparing the closed position of the movable unit 12 as shown in FIGS. 2 to 6 with the open position of the movable unit 12 as shown in FIG. 7, it is appreciated that a distance from a point I where the journal paper P2 separates from the roll to a point J corresponding to a lower end of the lower guide plate 16 in the closed position of the movable unit 12 is equal to a distance from a point K where the journal paper P2 separates from the roll to the point J in the open position of the movable unit 12. That is, the distance from a point I' corresponding to the point I shown in FIG. 6 to the point J is greater than the distance from the point I to the point J by the distance from the point K to the point I'.

Accordingly, when the movable unit 12 is opened from the closed position, it is necessary to forcibly rotate the take-up roller 33 in the unwinding direction by the length corresponding to the distance from the point I' to the point K. Reversely, when the movable unit 12 is closed from the open position, it is necessary to forcibly rotate the take-up roller 33 in the winding direction by the above length. As mentioned above, when the movable unit 12 is rotated, the take-up roller 33 is rotated in synchronism with the rotation of the movable unit 12 through the sector gear 39. More specifically, when the movable unit 12 is opened by a predetermined amount from the closed position, the gear 37*a* comes into meshing with the sector gear 39, and when the movable unit 12 is further opened, the gear 37*a* meshing with the sector gear 39 is rotated. As the gear 37*a* also meshes with the gear 34*a* mounted on the roller shaft 34 for the take-up roller 33, the take-up roller 33 is rotated in the unwinding direction of the journal paper P2. Accordingly, the journal paper P2 wound around the take-up roller 33 is unwound by an amount corresponding to the rotational amount of the movable unit 12, and it is prevented that the journal paper P2 received in the paper receiving portion 5 is taken up upon opening of the movable unit 12. Furthermore, when the movable unit 12 is opened by the resilient force of the springs 14, the resilient force is partially transmitted through the gear 37*a* meshing with the sector gear 39 to the belt drive mechanism 35. Accordingly, the resilient force of the springs 14 is partially damped by the rotational resistance of the belt drive mechanism 35, thus preventing the movable unit 12 from being suddenly opened.

Under the open condition of the movable unit 12, the roll papers P1 and/or P2 received in the paper receiving portions 5 may be exchanged, or the maintenance and inspection of the printer 1 may be carried out. In exchanging the roll papers P1 and/or P2, each leading end portion of the papers is drawn along the lower guide plate 16, the platen 15 and the upper guide plate 17. The leading end portion of the journal paper P2 is engaged on the outer circumference of the take-up roller 33.

When the movable unit 12 is closed from the open position after exchange of the roller papers P1 and/or P2 or maintenance and inspection of the printer, the take-up roller 33 is rotated in the winding direction to wind the leading end portion of the journal paper P2. Thus, the movable unit 12 is closed as rotating the take-up roller 33 in the winding direction. Therefore, it is possible to eliminate the generation of wrinkle or slack of the leading end portion of the journal paper P2. In the closed position of the movable unit 12, the lock levers 26 are rotated in the locking direction to lock the movable unit 12 in the closed position. Thus, the driven rollers 19' and 19 are retained to contact the drive rollers 18' and 18 with the papers P1 and P2 interposed therebetween.

Although the take-up roller 33 is rotated in the paper unwinding direction upon opening the movable unit 12, while the take-up roller 33 is rotated in the paper winding direction upon closing the movable unit 12 in the above preferred embodiment, the present invention is not limited to this construction. For example, only when the movable unit 12 is closed, the take-up roller 33 may be rotated in the paper winding direction. In this case, when the movable unit 12 is opened, the journal paper P2 is drawn from the roll in the paper receiving portion 5, and the drawn portion of the paper P2 is taken-up by the take-up roller 33 upon closing the movable unit 12, thus preventing the generation of wrinkle or slack of the paper P2.

In another case, an additional take-up roller may be provided at the bottom of the paper receiving portion 5 or at the core of the roll of the journal paper P2, so as to rotate the additional take-up roller in the paper winding direction in synchronism with the closing operation of the movable unit 12 through an interlocking mechanism. That is, the drawn portion of the journal paper P2 upon opening the movable unit 12 is rewound around the roll of the journal paper P2, so that the generation of wrinkle or slack of the journal paper P2.

Further, as the drive rollers 18' and 18 and the driven rollers 19' and 19 are located downstream of the printing head 8 and the platen 15, the generation of slack of the leading end portions of the papers P1 and P2 is suppressed at the upstream and downstream positions of the printing head 8 and the platen 15.

After the papers P1 and P2 are fed, the printing head 8 is driven by the printing head driving device installed in the register to carry out the same printing with respect to the papers P1 and P2 according to print data outputted from a print control device.

There is defined a gap between the printing head 8 and the platen 15 so as to insert the thickness of the paper P1 or P2 plus the thickness of the cut-sheet paper P3 as shown in FIG. 4. Furthermore, the drive rollers 18' and 18 and the driven rollers 19' and 19 are offset from an extension of the gap to the side of the platen 15, so as not to hinder the insertion of the cut-sheet paper P3 from the upper side of the printer 1. In the preferred embodiment, the cut-sheet paper P3 is inserted into the gap between the printing head 8 and the platen 15 in such a manner as to contact the receipt paper P1.

In exchanging the roll papers P1 and/or P2 by opening the movable unit 12 from the closed position, the lock levers 26 are first rotated in the unlocking direction (in the counterclockwise direction as viewed in FIG. 2) against the biasing force of the springs 29. During the counterclockwise rotation of the lock levers 26, the driven roller shaft 24 with the driven rollers 19' and 19 is urged by the cam surface of the cam holes 30 of the lock levers 26 against the biasing force of the springs 25, and is upwardly moved along the elongated holes 23 of the body frame 3. When the lock levers 26 are finally brought into the unlocking position, the driven roller shaft 24 with the driven rollers 19' and 19 is retracted to a position outside the locus of the outer profile of the movable unit 12.

In the unlock position of the lock levers 26 as shown in FIG. 6, the lock pawls **26*a* of the lock levers 26 are brought into disengagement from the lock pins 28 of the movable unit 12. As a result, the movable unit 12 is rotated about the support pins 13 by the biasing force of the springs 14 in the clockwise direction as viewed in FIG. 7. Under the open condition of the movable unit 12, the roll papers P1 and/or P2 are exchanged with respect to the paper receiving portions 5 of the paper holder 4**.

After the exchanging of the roll papers P1 and/or P2, the roll papers P1 and/or P2 are taken-up to extend along the lower guide plate 16, the platen 15 and the upper guide plate 17. The leading end portion of the journal paper P2 only is engaged on the outer circumference of the take-up roller 33.

Under the condition where a given length of the papers P1 and P2 are taken-up, the movable unit 12 is closed. Then, the lock levers 26 are rotated to the lock position. As a result, the lock pawls **26*a* of the lock levers 26 are brought into engagement with the lock pins 28 of the movable unit 12, thereby locking the movable unit 12 in the closed position. At the same time, the driven roller shaft 24 with the driven rollers 19' and 19 is lowered along the elongated holes 23 of the body frame 3 by the cam surfaces of the cam holes 30 until the driven rollers 19' and 19 are brought into cotact with the drive rollers 18' and 18 with the papers P1 and P2 interposed therebetween, respectively, and are retained in this paper feeding position by the biasing force of the springs 25. Thus, the leading end portions of the papers P1 and P2 are set between the printing head 8 and the platen 5 and between the drive and driven rollers 18', 18 and 19', 19, respectively. Therefore, the roll papers P1 and P2** can be easily set in a ready position for printing.

The recording apparatus of the preferred embodiment is provided with a paper end detecting means for detecting a residual amount of the roll papers P1 and P2 less than a predetermined amount. Such paper end detecting means is disclosed in Japanese Utility Model Publication No. 56-36837, for example. In this prior art, a paper end detecting lever is provided at one end of side walls of a roll paper holder in such a manner as to normally abut against a side surface of a roll paper. A lower end of the lever is located at a level just higher than a diameter of a core of the roll paper. When a diameter of the roll paper becomes a predetermined value, that is, a residual amount of the roll paper becomes a predetermined amount, the lower end of the lever comes out of contact with the side surface of the roll paper. At this time, an indicator or an alarm is operated to inform an operator of paper ending.

However, in the conventional paper end detecting device as mentioned above, when the residual amount of the roll paper becomes the predetermined amount or less, the contact of the lever with the side surface of the roll paper is released, and as a result, the lower end of the lever is moved over the outer circumferential surface of the roll paper, causing hindrance of exchange of the roll paper. Accordingly, when the roll paper is exchanged, it is necessary to retract the lever by a hand or the like or incline the roll paper so as to avoid contact with the lever. Thus, the exchange of the roll paper is troublesome.

Furthermore, if the roll paper is slacked, the apparent diameter of the roll paper would be greater than the proper diameter of the roll paper. Accordingly, even when the residual amount of the roll paper becomes the predetermined amount or less, the lower end of the lever is maintained in contact with the side surface of the roll paper, resulting in malfunction of the paper end detecting device.

Figure 8:
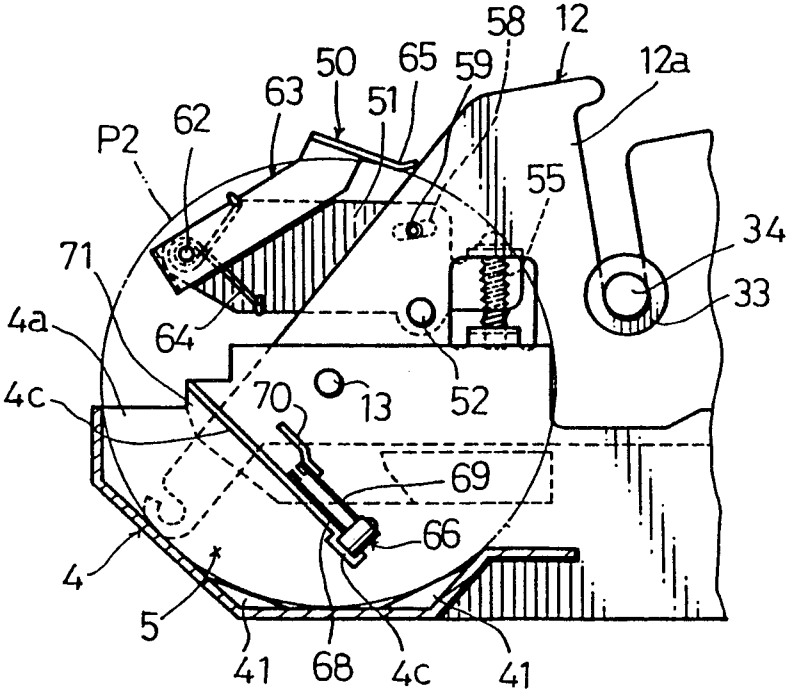
FIG. 8 is a sectional side view of a paper end detecting device according to the present invention.
Figure 9:
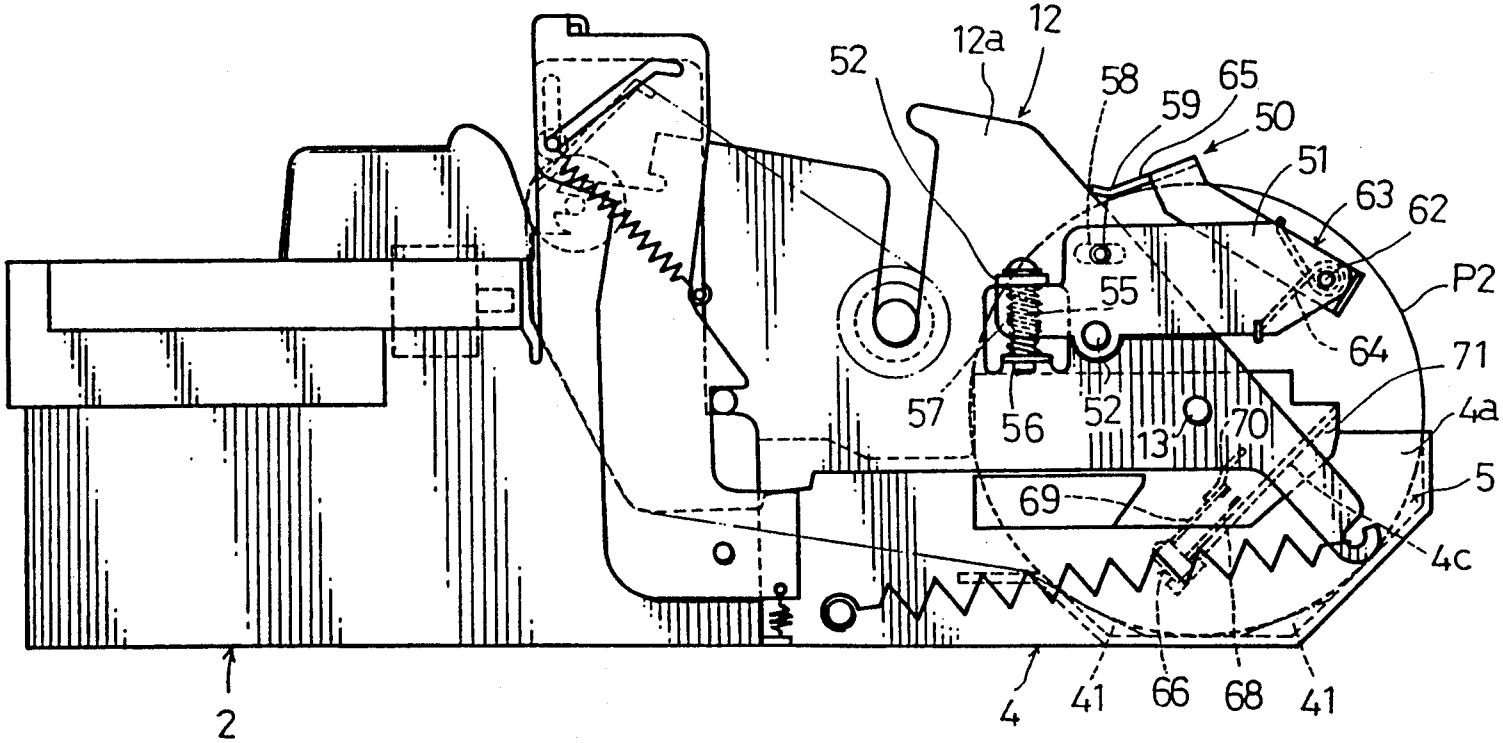
FIG. 9 is a side view of the printer including the paper end detecting device.
Figure 10:
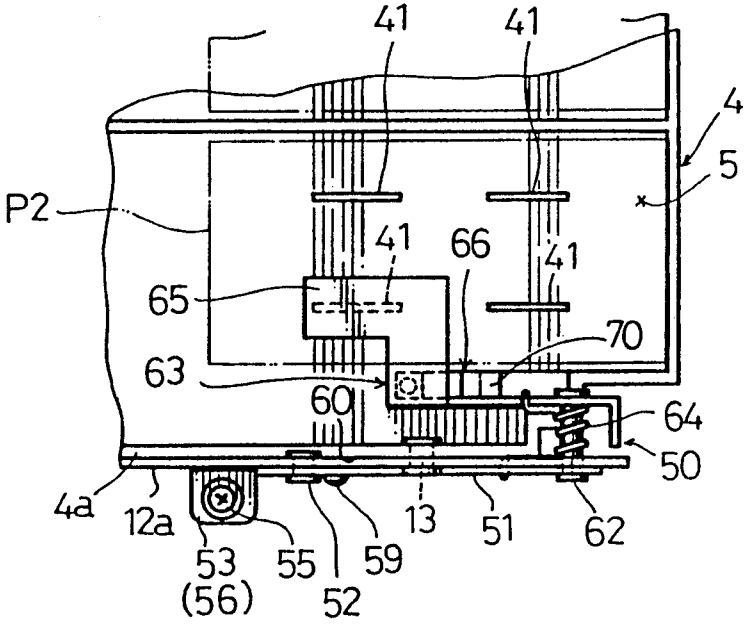
FIG. 10 is a plan view of the paper end detecting device.

Such problems have been solved by the construction of the preferred embodiment. Referring to FIGS. 8, 9 and 10, reference numeral 50 designate a pair of paper end detecting devices to be provided for the receipt roll paper P1 and the journal roll paper P2, respectively. As both the paper end detecting devices have the same construction, the following description will be referred to the paper end detecting device 50 for the journal roll paper P2 only. The paper receiving portions 5 are formed with plural roll guides 41 projecting upwardly from the bottom surface of each paper receiving portion 5. Each roll guide 41 has an arcuate upper surface corresponding to the outer circumference of the roll papers, so as to guide each roll paper in such a manner that the axis of each roll paper may be lowered along substantially the same vertical line as the residual amount of the paper is reduced.

A mounting plate 51 is pivotably mounted at its substantially central portion to a mounting shaft 52 on the outer side of the side plate 12*a* of the movable unit 12. The mounting plate 51 is formed at its front end (left end as viewed in FIG. 9) with a bent portion 53 projecting laterally outwardly. On the other hand, the side plate 12*a* of the movable unit 12 is formed with a bent portion 56 projecting laterally outwardly in parallel relationship to the bent portion 53 of the mounting plate 51. An adjusting screw 55 is inserted through the bent portion 53 of the mounting plate 51, and a lower end portion of the screw 55 is threadedly engaged with the bent portion 56 of the side plate 12*a* of the movable unit 12. An adjusting spring 57 for normally biasing the mounting plate 51 in the clockwise direction as viewed in FIG. 9 is provided under compression between both the bent portions 53 and 56 around the adjusting screw 55. The mounting plate 51 is formed with an arcuate adjusting hole 58 forming an arc about the mounting shaft 52, and a tapped hole 60 is formed through the side plate 12*a* of the movable unit 12 in opposed relationship to the adjusting hole 58. A tightening screw 60 is inserted through the adjusting hole 58, and is threadedly engaged with the tapped hole 60, thus fixedly mounting the mounting plate 51 to the side plate 12*a* of the movable unit 12.

The mounting plate 51 is formed at its rear end (right end as viewed in FIG. 9) with a lever shaft 62 projecting laterally inwardly in parallel relationship to the axis of the roll of the journal paper P2. A detecting lever 63 is rotatably mounted at its base portion to the lever shaft 62. A torque spring 64 is mounted around the lever shaft 62, and one end of the torque spring 64 is engaged with the detecting lever 63, while the other end is engaged with the mounting plate 51. The torque spring 64 normally biases the detecting lever 63 in the counterclockwise direction as viewed in FIG. 9. The detecting lever 63 is formed at its front end with an abutting portion 65 normally abutting against the outer circumferential surface of the roll of the journal paper P2.

The side wall 4*a* of the paper holder 4 is formed with a slant supporting portion 4*c* projecting inwardly, and a detecting switch 66 is mounted on the slant supporting portion 4*c*. The detecting switch 66 is a normally open type switch including a fixed contact 68 mounted on the slant supporting portion 4*c* and a movable contact 69 contactable with the fixed contact 68. The movable contact 69 is formed of a leaf spring having a suitable elasticity, and it is provided at its movable end with a detecting portion 70 located on a locus of rotation of the detecting lever 63.

When a sufficient amount of the roll paper P2 is present, the abutting portion 65 of the detecting lever 63 abuts against the outer circumferential surface of the roll paper P2 by the elastic force of the torque spring 64. Under the condition, the detecting switch 66 is maintained in an off-state.

Figure 11:
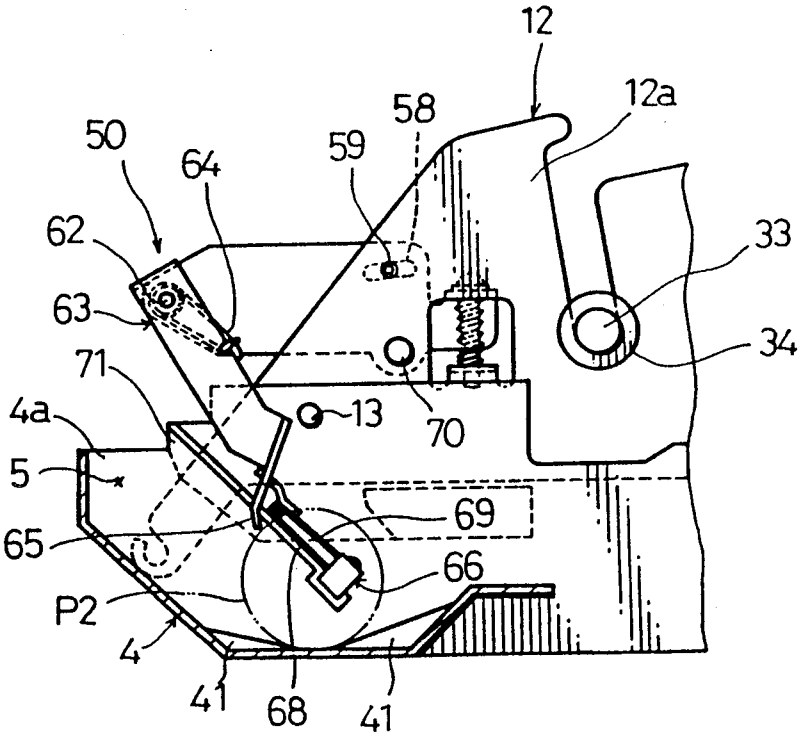
FIG. 11 is a view similar to FIG. 8 under the condition where a detecting switch of the paper end detecting device is operated.

During printing, the diameter of the roll of the journal paper P2 is gradually reduced, and the detecting lever 63 is rotated about the lever shaft 62 by the resilient force of the torque spring 64 under the condition where the abutting portion 65 of the detecting lever 63 contacts the outer circumferential surface of the roll paper P2. Thereafter, when the diameter of the roll paper P2 becomes a predetermined value or less, the abutting portion 65 comes out of contact with the outer circumferential surface of the roll paper P2 as shown in FIG. 11. At this time, the detecting lever 63 is brought into abutment against the detecting portion 70 of the detecting switch 66. As a result, the movable contact 69 is brought into contact with the fixed contact 68, thereby turning on the detecting switch 66 and outputting a detection signal to a suitable indicating or alarming means. Accordingly, an operator can confirm that the residual amount of the journal paper P2 has become the predetermined amount. The detecting lever 63 can be adjusted by adjusting the screws 55 and 59 in accordance with the diameter of the roll paper P2 which depends on the diameter of the core of the roll.

Figure 12:
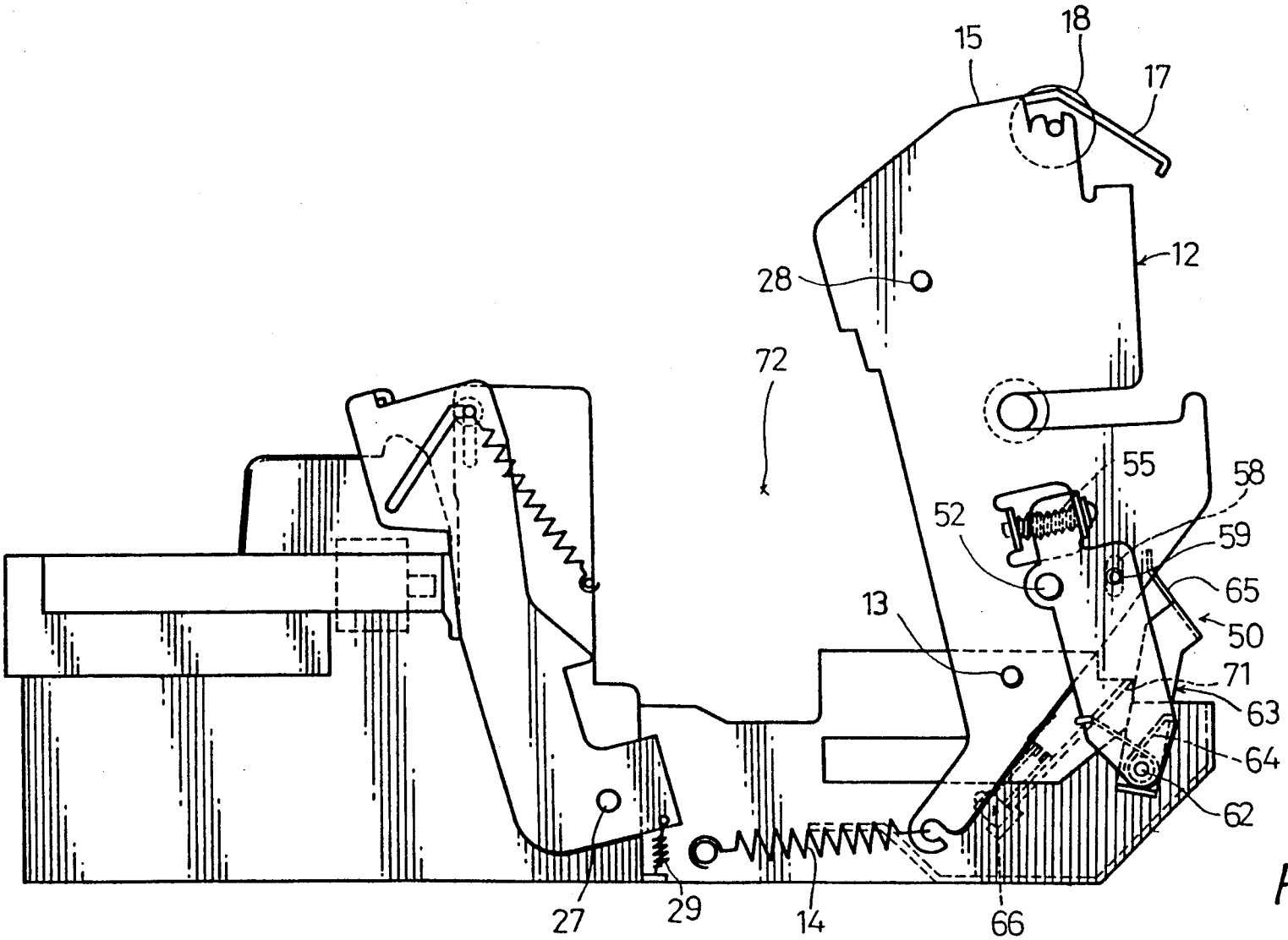
FIG. 12 is a view similar to FIG. 9 under the condition where the movable unit is in the open position.
Figure 13:
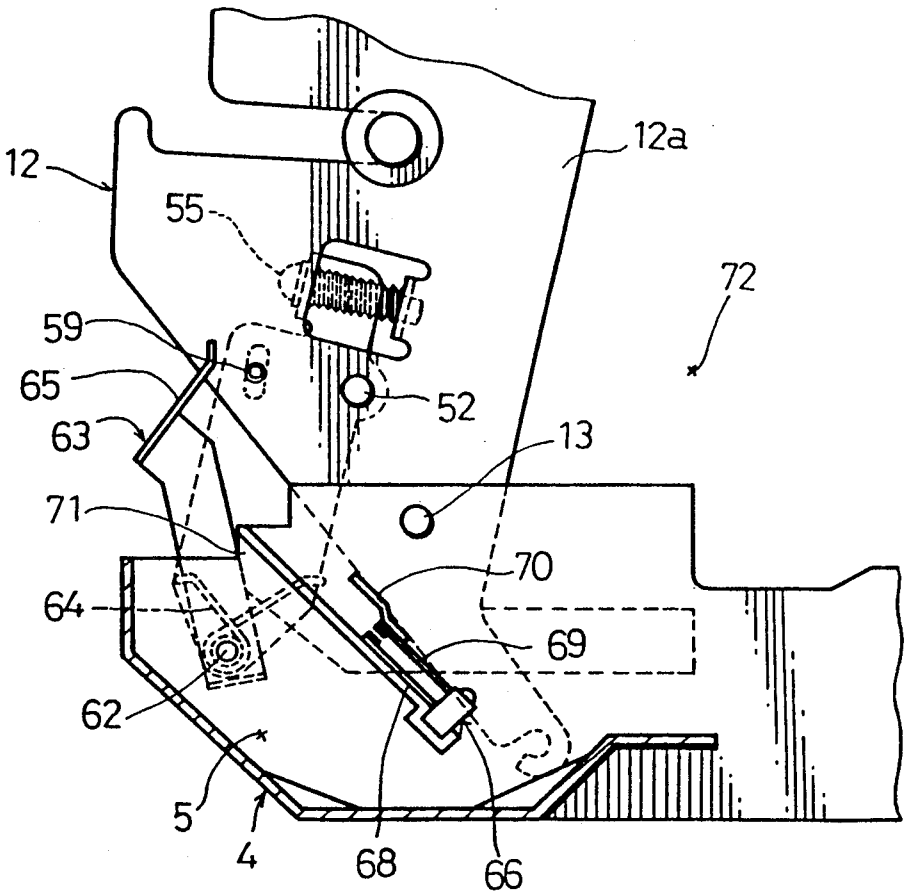
FIG. 13 is a view similar to FIG. 11 under the condition of FIG. 12.

The paper end detecting device is provided with a mechanism for preventing hindrance of the detecting lever 63 upon exchanging of the roll paper. The side wall 4*a* of the paper holder 4 is formed at its rear portion with a stepped lever stopper 71 projecting laterally outwardly. The lever stopper 71 is so located as to abut against the detecting lever 63 upon opening of the movable unit 12. That is, when the movable unit 12 is rotated about the pins 13 to open from the closed position as shown in FIG. 11, the detecting lever 63 is rotated about the pins 13 in the couterclockwise direction as viewed in FIG. 11. During the rotation of the detecting lever 63, it comes into abutment against the lever stopper 71. Thereafter, when the movable unit 12 is further rotated in the couterclockwise direction, the detecting lever 63 is rotated about a contact point between the same and the lever stopper 71 in the couterclockwise direction. As a result, the front end portion 65 of the lever 63 is finally directed to the upper side and is retracted from the paper receiving portion 5 as shown in FIG. 12. Thus, the upper side 72 of the paper receiving portions 5 is opened to allow an operator to exchange the roll paper P2 without being hindered by the detecting lever 63.

In closing the movable unit 12, the detecting lever 63 is returned by the resilient force of the spring 64 until the lever 63 contacts the outer circumference of the roll paper P2 newly set in the paper receiving portion 5 of the paper holder 4. Then, the lever 63 separates from the lever stopper 71 in contact with the outer circumference of the roll paper P2. Finally, the detecting lever 63 is brought into the condition as shown in FIG. 9.

As mentioned above, the detecting lever 63 is retracted from the upper side of the paper receiving portion 5 by opening the movable unit 12. Accordingly, the roll paper P2 can be smoothly and easily exchanged without being hindered by the detecting lever 63.

Further, as the detecting lever 63 normally contacts the outer circumference of the roll paper P2 under the pressure of the spring 64, the possibility of slack of the roll paper may be prevented in comparison with the above-mentioned prior art device wherein the detecting lever contacts the side surface of the roll paper. Accordingly, malfunction of the paper end detecting device due to such slack of the roll paper may be prevented to thereby improve the reliability of detection.

Further, as the detecting lever 63 is automatically brought into contact with the outer circumference of the roll paper P2 by closing the movable unit 12, the detecting device is easily set into a ready condition for detection.

The detecting position of the detecting lever 63 depends on a diameter of the core of the roll paper. That is, if the diameter of the core is large, there is a possibility that the detecting device will not properly detect the predetermined residual amount of the roll paper though the residual amount becomes less than the predetermined amount. In contrast, if the diameter of the core is small, there is a possibility that the detecting device will improperly early detect the residual amount though the residual amount is yet more than the predetermined residual amount.

In the preferred embodiment, such a defect can be eliminated by the adjusting mechanism to be described below.

Figure 15:
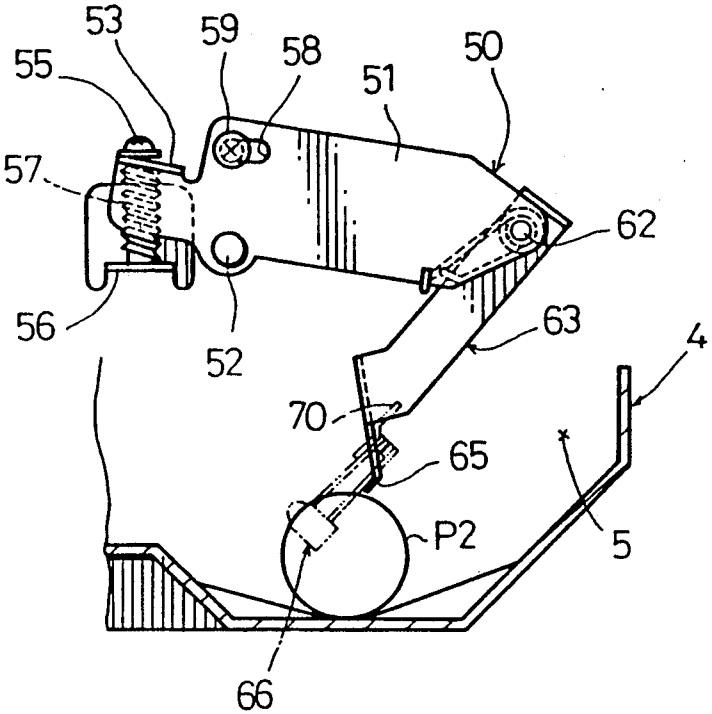
FIGS. 14 and 15 are side views of the paper end detecting device wherein a detecting position of the detecting switch is adjusted.
Figure 14:
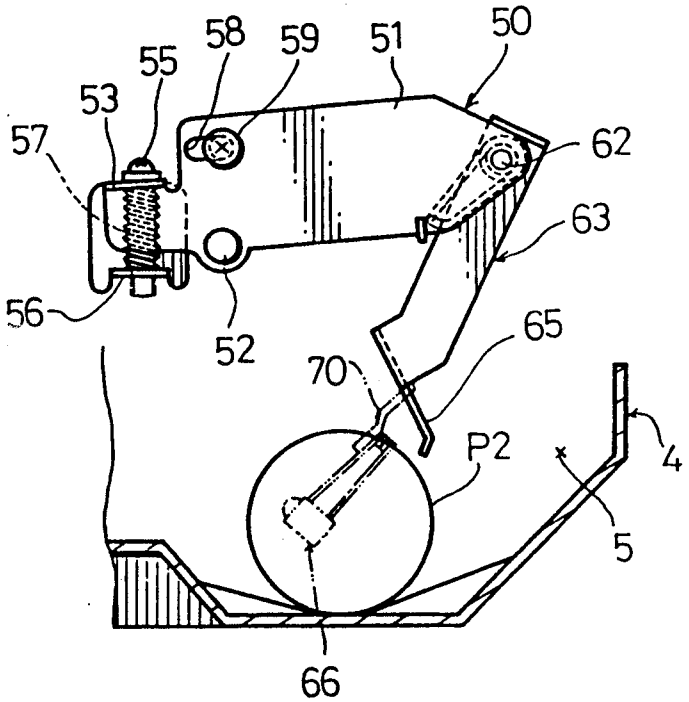

As shown in FIGS. 14 and 15, the mounting plate 51 can be rotated about the shaft 52 by loosening the tightening screw 59 and then adjusting the adjusting screw 55 so that the detecting lever 63 may be set to a proper position. Specifically, when the diameter of the core of the roll paper P2 is large as shown in FIG. 14, the adjusting screw 55 is rotated in its tightening direction to thereby rotate the mounting plate 51 about the shaft 52 in the counterclockwise direction as viewed in FIG. 14. As a result, the detecting lever 63 connected to the mounting plate 51 is moved upwardly, and the detecting position is adjusted to a higher position. In contrast, when the diameter of the core of the roll paper P2 is small as shown in FIG. 15, the adjusting screw 55 is rotated in its loosening direction to thereby rotate the mounting plate 51 about the shaft 52 in the clockwise direction as viewed in FIG. 15. As a result, the detecting lever 63 is moved downwardly, and the detecting position is adjusted to a lower position. After the adjustment of the detecting position of the detecting lever 63, the tightening screw 59 is tightened to fix the mounting plate 51 to the side plate 12*a* of the movable unit 12. Thus, the detecting lever 63 can be adjusted to a proper position in dependence on the diameter of the core of the roll paper so that the accuracy of the detection may be ensured.

Although the above-mentioned preferred embodiment is applied to a detecting device for detecting a paper end of the roll paper for use with the printer installed in the electronic cash register, the detecting device may be applied to a roll paper for any other printers or a facsimile device and a punch tape for an information recording device for recording information according to a punch hole.

Although the detecting lever 63 is mounted to the movable unit 12, and the detecting switch 66 as well as the lever stopper 71 is mounted to the paper holder 4 in the above preferred embodiment, the lever 63 may be mounted to the paper holder 4, and the switch 66 as well as the stopper 71 may be mounted to the movable unit 12. Alternatively, the detecting lever 63 may be slidably mounted to the side plate 12*a* of the movable unit 12. Further, in receipt of the detection signal to be generated from the detecting switch 66, the printer driver may be stopped.

Figure 16:
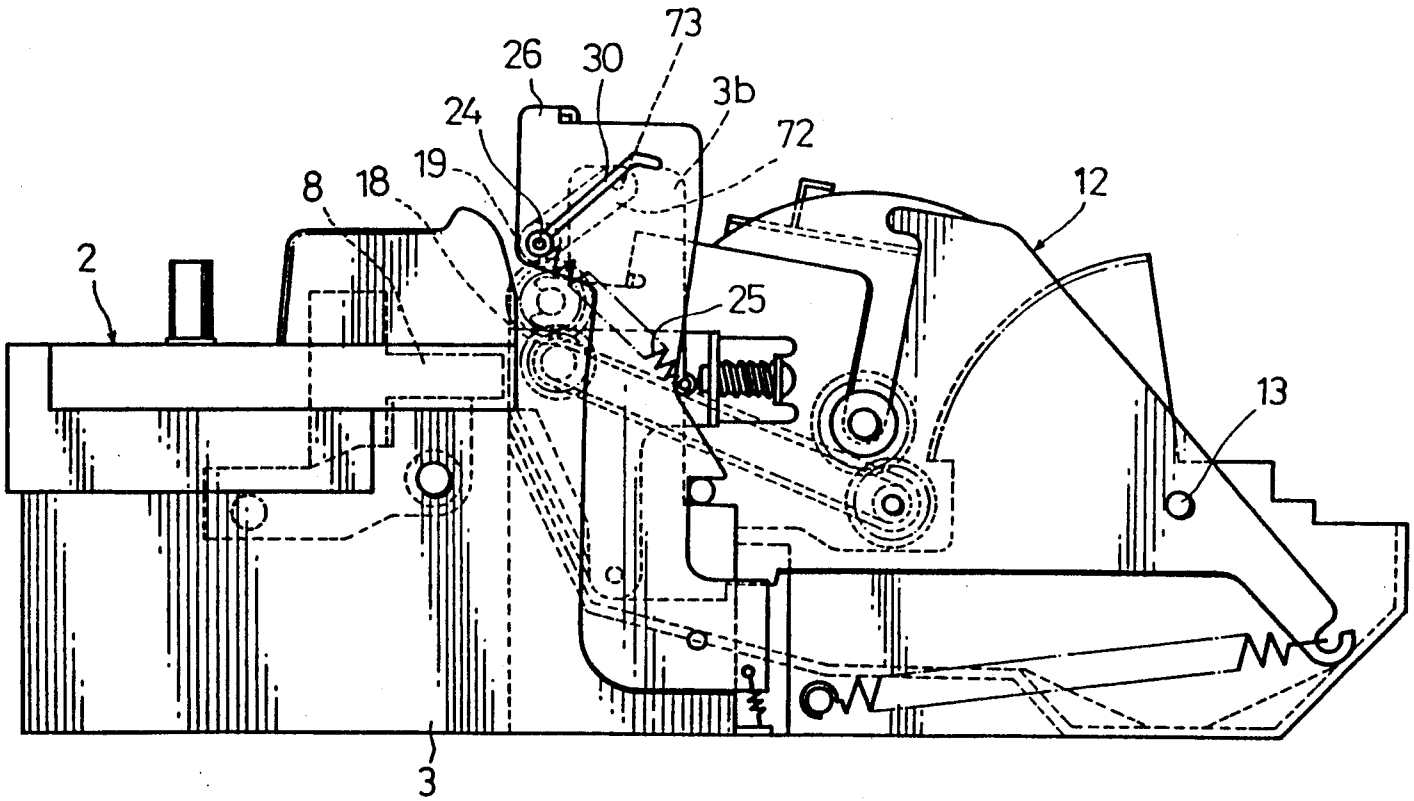
FIGS. 16 and 17 are side elevational views of the printer of a second preferred embodiment according to the present invention under the closed position and the open position of the movable unit, respectively.
Figure 17:
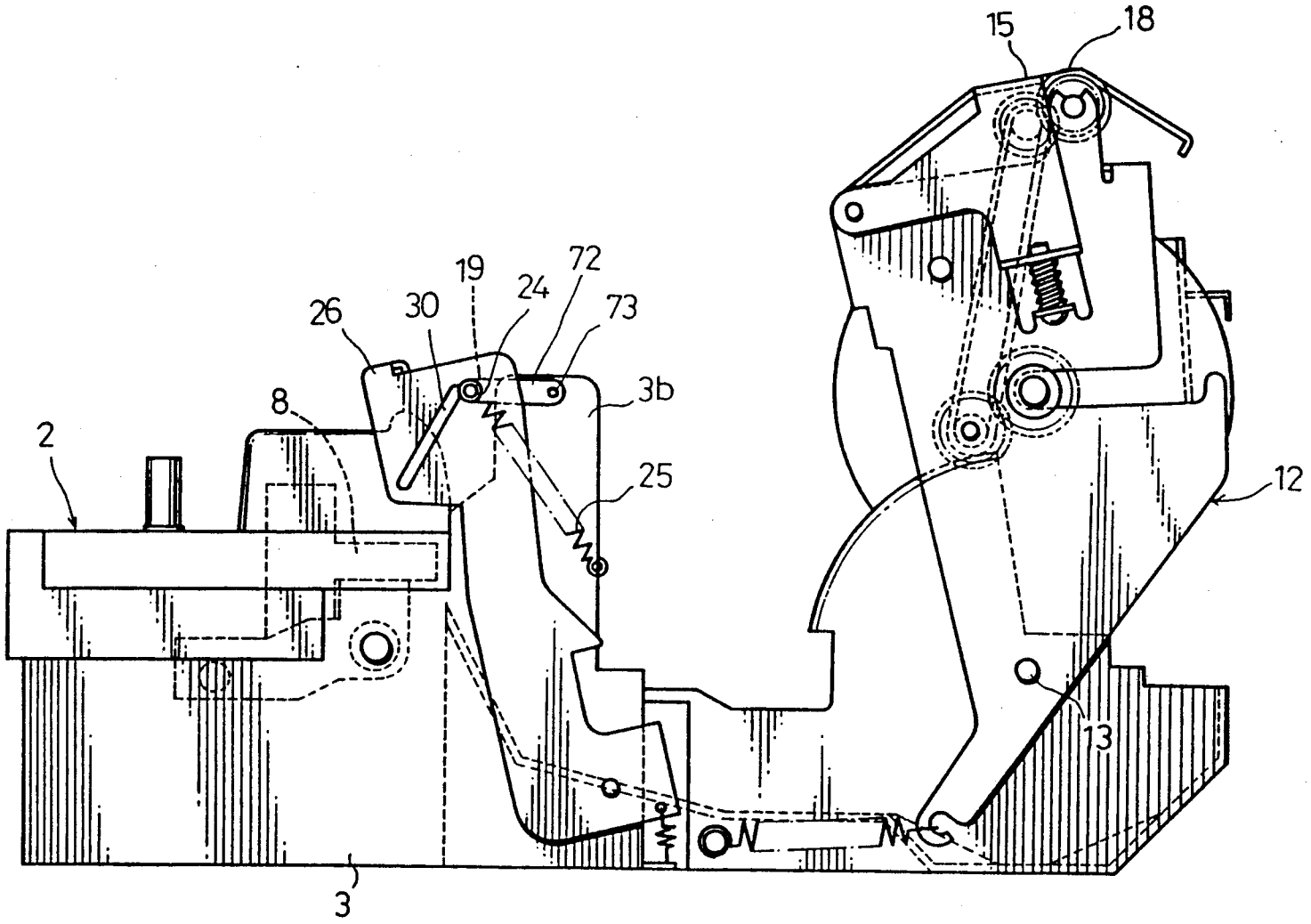

Referring next to FIGS. 16 and 17 which show a second preferred embodiment of the present invention, a pair of pivotable arms 72 are pivotably mounted at their base end portions to a pair of pins 73 fixed to the right and left support walls 3*b* of the body frame 3, and the driven roller shaft 24 of the driven rollers 19' and 19 is supported between the front end portions of the pivotable arms 72. In operation, when the lock levers 26 are rotated in the unlocking direction as shown in FIG. 17, the driven roller shaft 24 is urged by the cam surface of the cam holes 30, and is rotated with the pivotable arms 72. In the unlock position of the lock levers 26, the driven rollers 19' and 19 are located outside the locus of the outer profile of the movable unit 12. The other parts are same as in the first preferred embodiment, and the explanation thereof will be therefore omitted.

Figure 19:
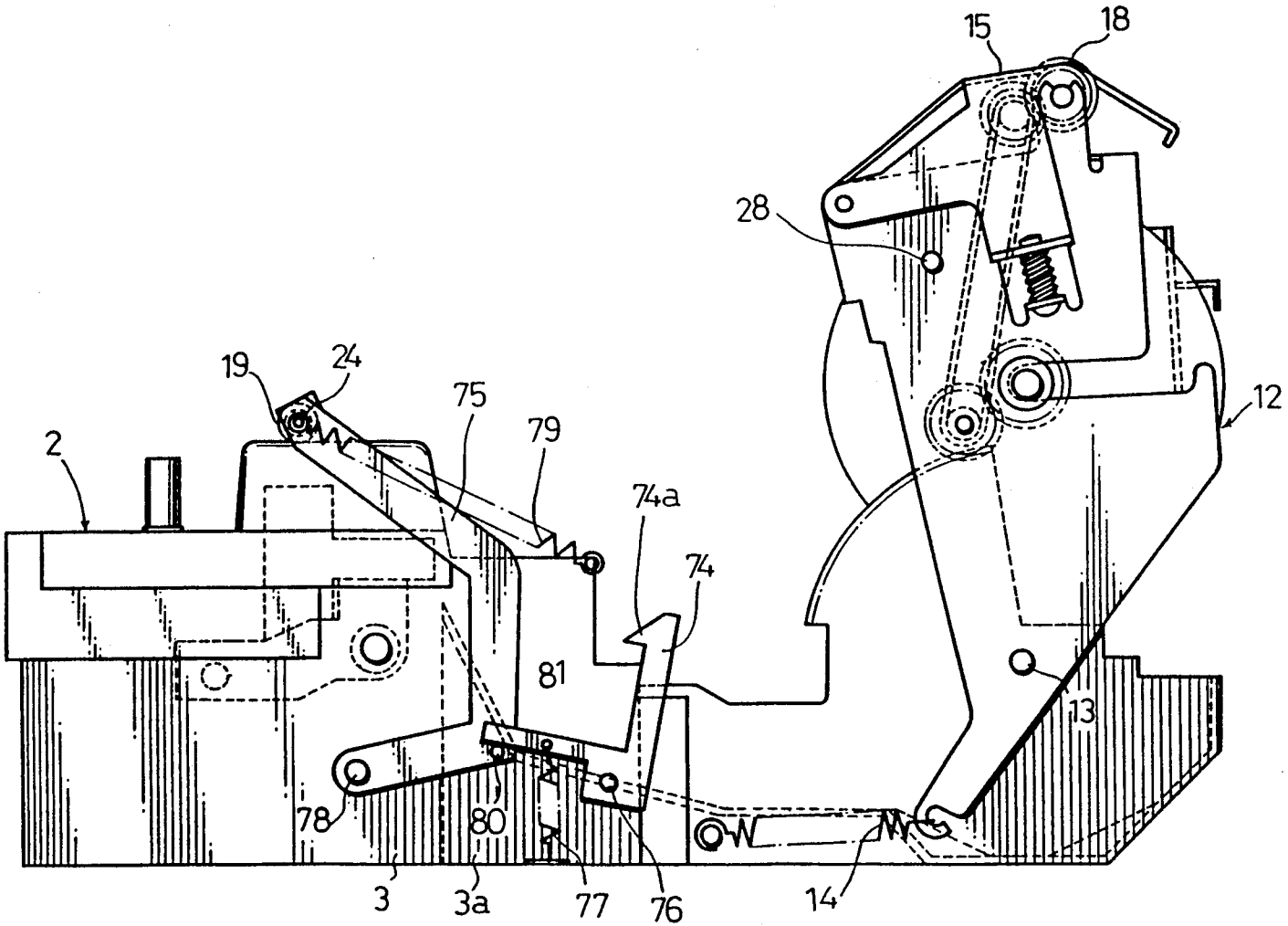
Figure 20:
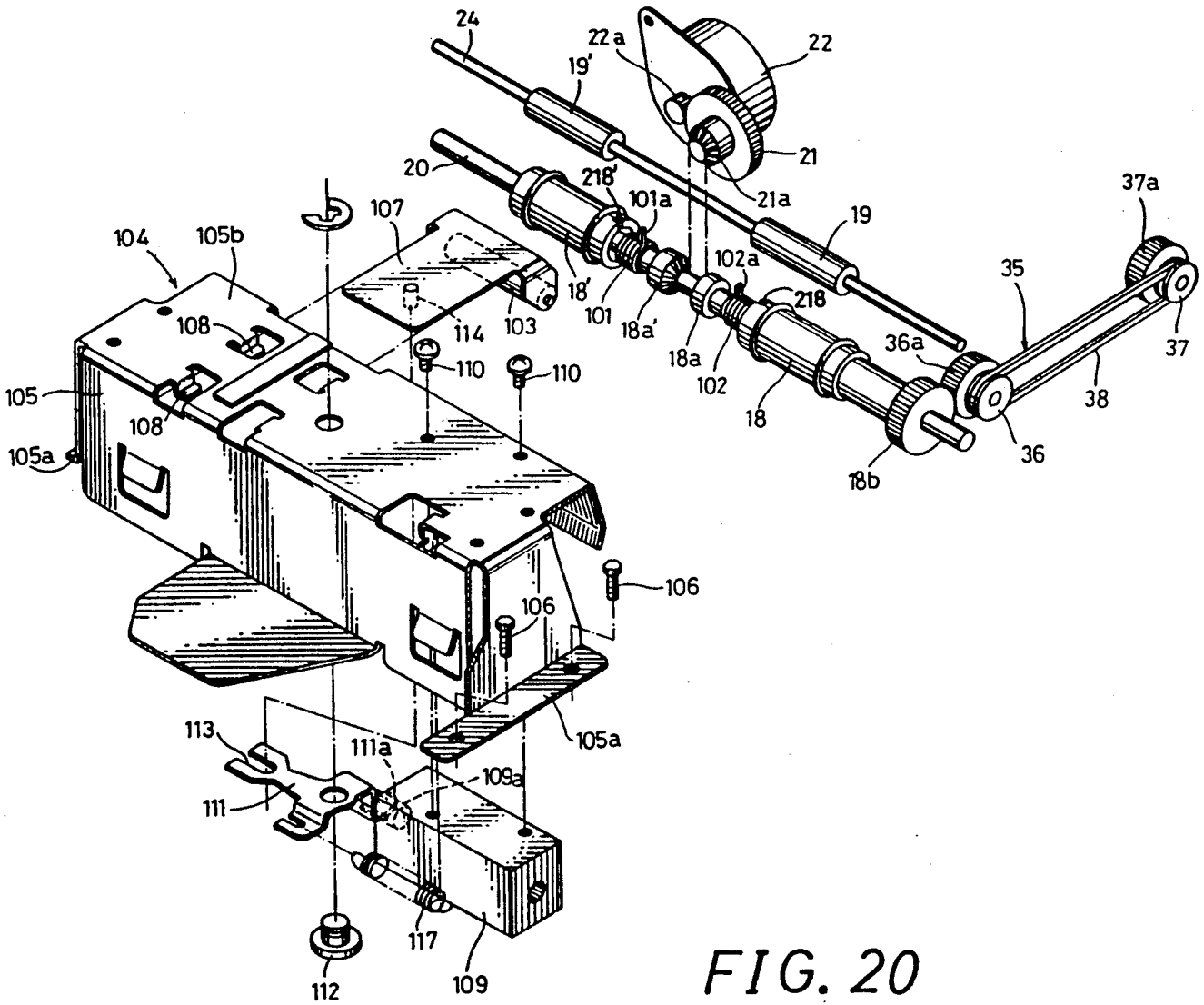
FIG. 20 is an exploded perspective view of an essential part of a fourth preferred embodiment of the present invention.

Referring next to FIGS. 19 and 20 which show a third preferred embodiment of the present invention, a pair of lock levers 74 for locking the movable unit 12 at the closed position with respect to the fixed unit 2 and a pair of unlock levers 75 for unlocking the lock levers 74 are pivotably arranged outside the right and left side walls 3*a* of the body frame 3.

The lock levers 74 are pivotably supported to a pair of pins 76 fixed to the side walls 3*a*. Each lock lever 74 is formed at its upper end with a lock pawl 74*a* engageable with the lock pin 28 of the movable unit 12. The lock levers 74 are normally biased by a pair of tensile springs 77 so as to engage the lock pawls 74*a* with the lock pins 28.

Figure 18:
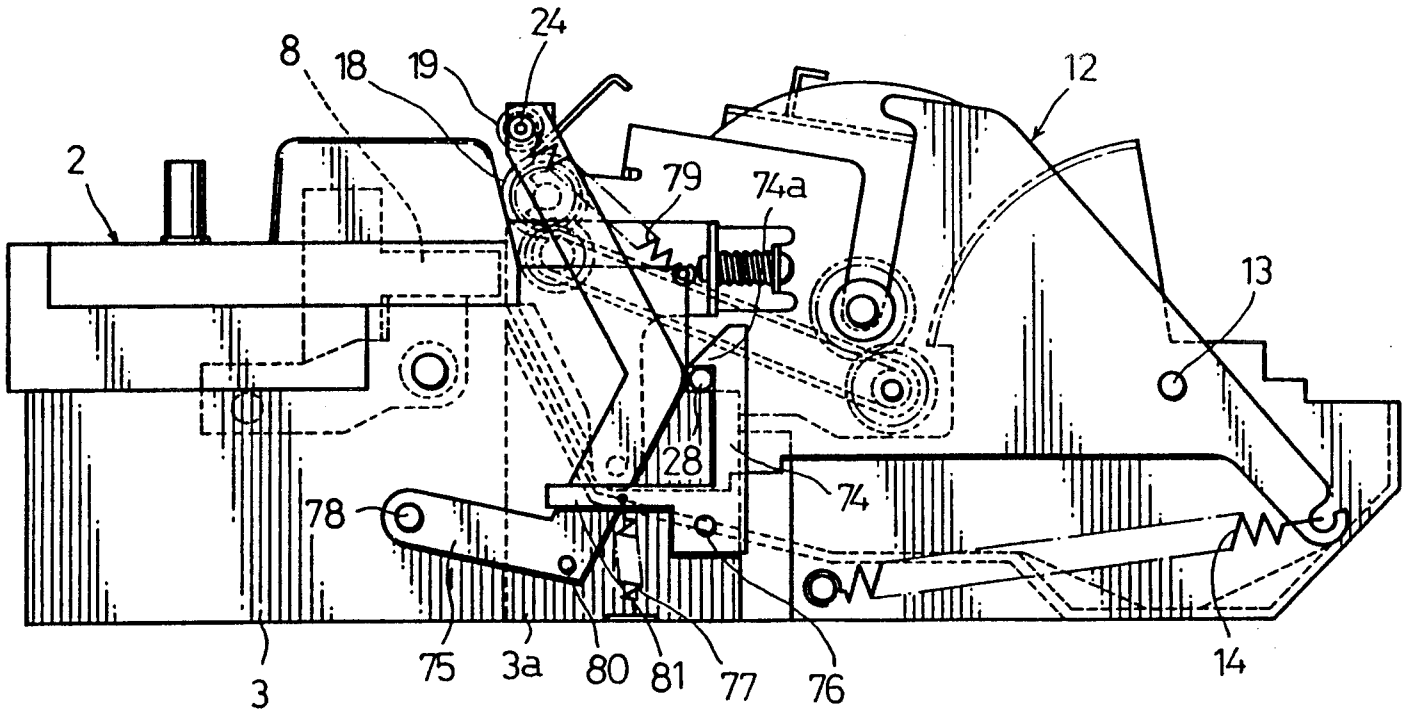
FIGS. 18 and 19 are views similar to FIGS. 16 and 17, showing a third preferred embodiment of the present invention.

The unlock levers 74 are also pivotably supported at their lower ends to a pair of pins 78 fixed to the side walls 3*a*. The driven roller shaft 24 is supported to the upper ends of the unlock levers 74. The driven rollers 19' and 19 to be driven by the drive rollers 18' and 18 are rotatably mounted on the driven roller shaft 24. A pair of springs 79 corresponding to the springs 25 in the previous preferred embodiments are provided between the driven roller shaft 24 and the side walls 3*a*. The unlock levers 75 are normally biased by the springs 79 to maintain the driven rollers 19' and 19 in contact with the drive rollers 18' and 18 under the closed condition of the movable unit 12 as shown in FIG. 18. On the other hand, when the unlock levers 75 are rotated in the counterclockwise direction as viewed in FIG. 19 against the biasing force of the springs 79, the driven rollers 19' and 19 are retracted to a position outside the locus of the outer profile of the movable unit 12.

Each unlock lever 75 is provided with an interlocking pin 80 abuttable against a lower surface of an interlocking extension 81 of each lock lever 74, so that when each unlock lever 75 is rotated to retract the driven rollers 19' and 19, each lock lever 74 may be rotated in the unlocking direction.

In opening the movable unit 12, each unlock lever 75 is rotated in the counterclockwise direction as viewed in FIG. 19, the interlocking pin 80 of each unlock lever 75 is brought into abutment against the interlocking extension 81 of each lock lever 74. Then, by further rotating each unlock lever 75, each lock lever 74 is rotated in the clockwise direction as viewed in FIG. 19, thereby disengaging the lock pawl 74*a* of each lock lever 74 from each lock pin 28. As a result, the movable unit 12 is opened by the biasing force of the springs 14. The other parts are same as in the first preferred embodiment, and the explanation thereof will be therefore omitted.

Although the drive rollers 18' and 18 are located on the movable unit 12 side and the driven rollers 19' and 19 are located on the fixed unit 2 side in the previous preferred embodiments, the driver rollers 18' and 18 may be located on the fixed unit 2 side and the driven rollers 19' and 19 may be located on the movable unit 12 side according to the present invention.

Referring next to FIGS. 20 to 23 which show a fourth preferred embodiment of the present invention, the one-way clutches are constituted of clutch coil springs 101 and 102. The clutch coil spring 101 is closely wound around a boss of the bevel gear 18*a'*, and the clutch coil spring 102 is similarly closedly wound around a boss of the bevel gear 18*a*. One end 101*a* of the clutch spring 101 is engaged with a recess 218' formed on an end surface of the drive roller 18', and one end 102a of the clutch spring 102 is similarly engaged with a recess 218 formed on an end surface of the drive roller 18. When the reversible motor 22 is rotated in one direction, the driving torque of the motor 22 is transmitted through the gears 22a, 21 and 21a to both the bevel gears 18a and 18a'. At this time, either of the clutch spring 101 or 102 is shrunk in its diameter owing to friction between the inner periphery of the clutch spring and the outer periphery of the boss of the bevel gear 18a or 18a', and the driving torque is transmitted to the drive roller 18 or 18'. On the other hand, the other clutch spring is slipped on the boss of the other bevel gear, and therefore the driving torque is not transmitted to the other drive roller.

Figure 22:
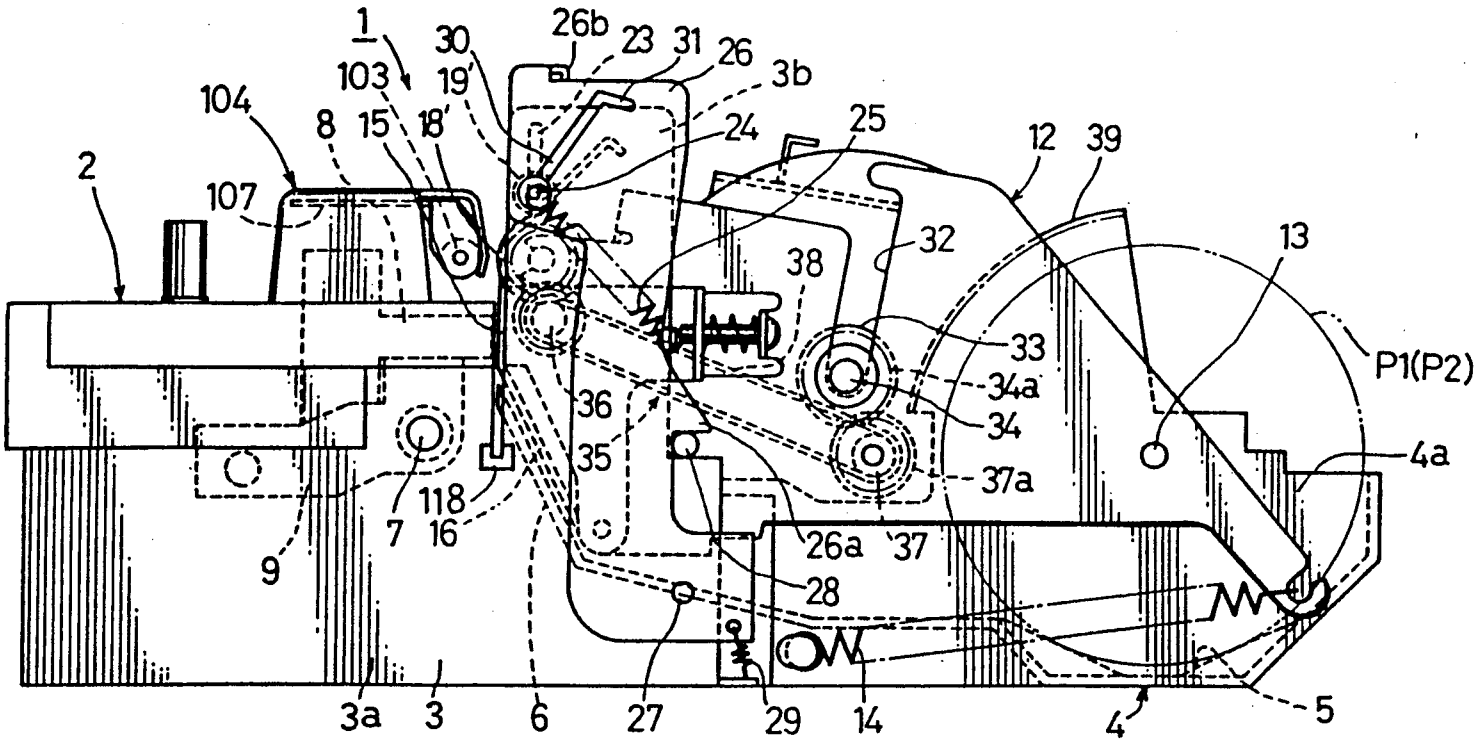
FIG. 22 is a side elevational view of the fourth preferred embodiment.

Reference numeral 103 designates an additional driven roller for feeding the cut-sheet paper P3. The driven roller 103 is opposed to the drive roller 18', and is adapted to contact the same. A paper feeding unit 104 for feeding the cut-sheet paper P3 includes the driven roller 103, and is detachably mounted on the upper surface of the fixed unit 2 in such a manner as to cover the printing head 8 as shown in FIG. 22. As shown in FIG. 20, a mounting frame 105 of the paper feeding unit 104 is constructed in a rectangular box-like configuration opened at its lower side. The mounting frame 105 is formed with opposite flanges 105a to be detachably fixed to the upper surface of the fixed unit 2 by screws 106.

A top plate 105b of the mounting frame 105 is formed with four guide elements 108 for guiding a slidable plate 107 rotatably supporting the driven roller 103. A solenoid actuator 109 is fixed to the lower surface of the top plate 105b by screws 110. A plunger 109a of the solenoid actuator 109 is interlockingly connected through an interlocking arm 111 to the slidable plate 107.

Figure 21:
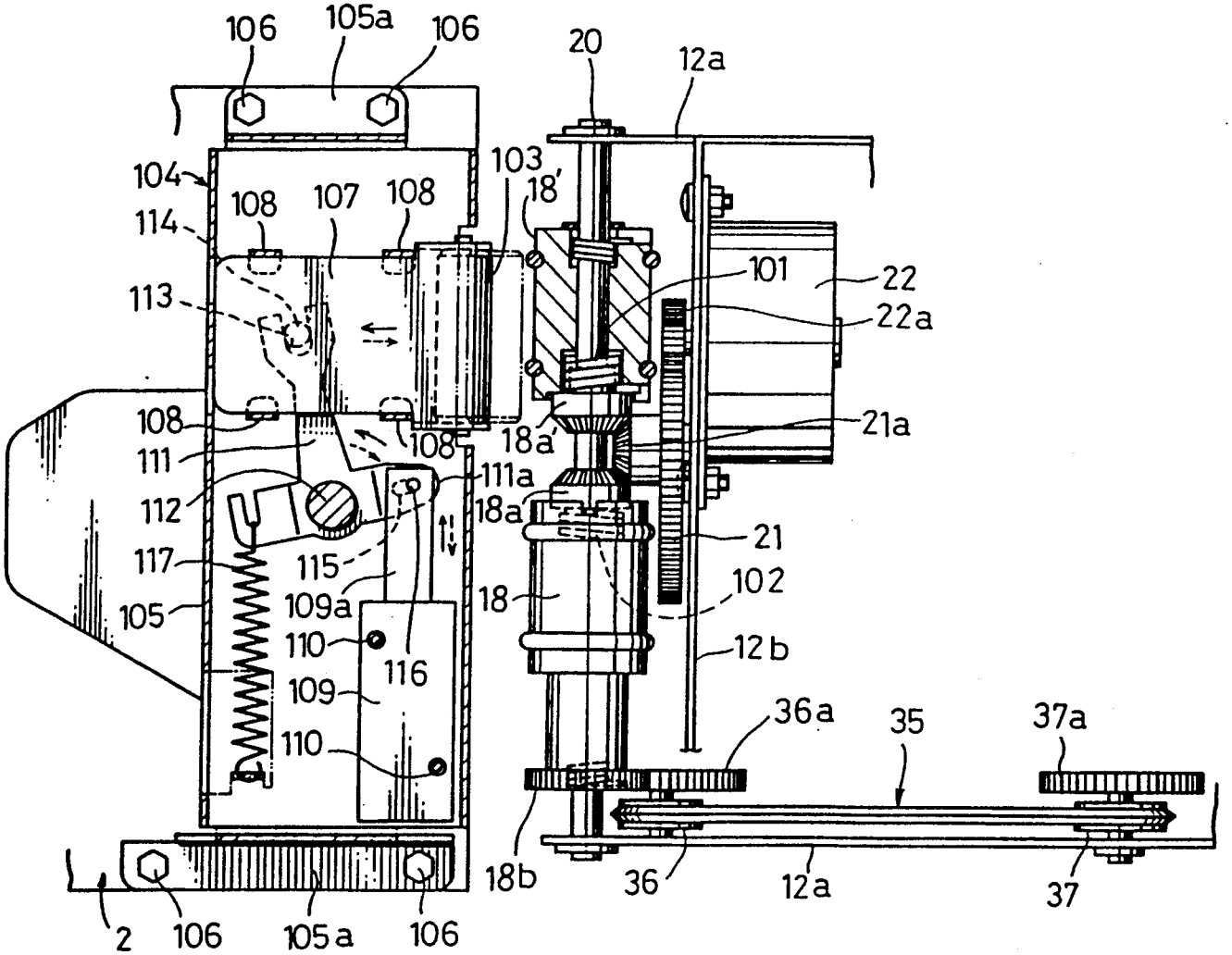
FIG. 21 is a horizontal sectional view of the essential part shown in FIG. 20.
Figure 23:
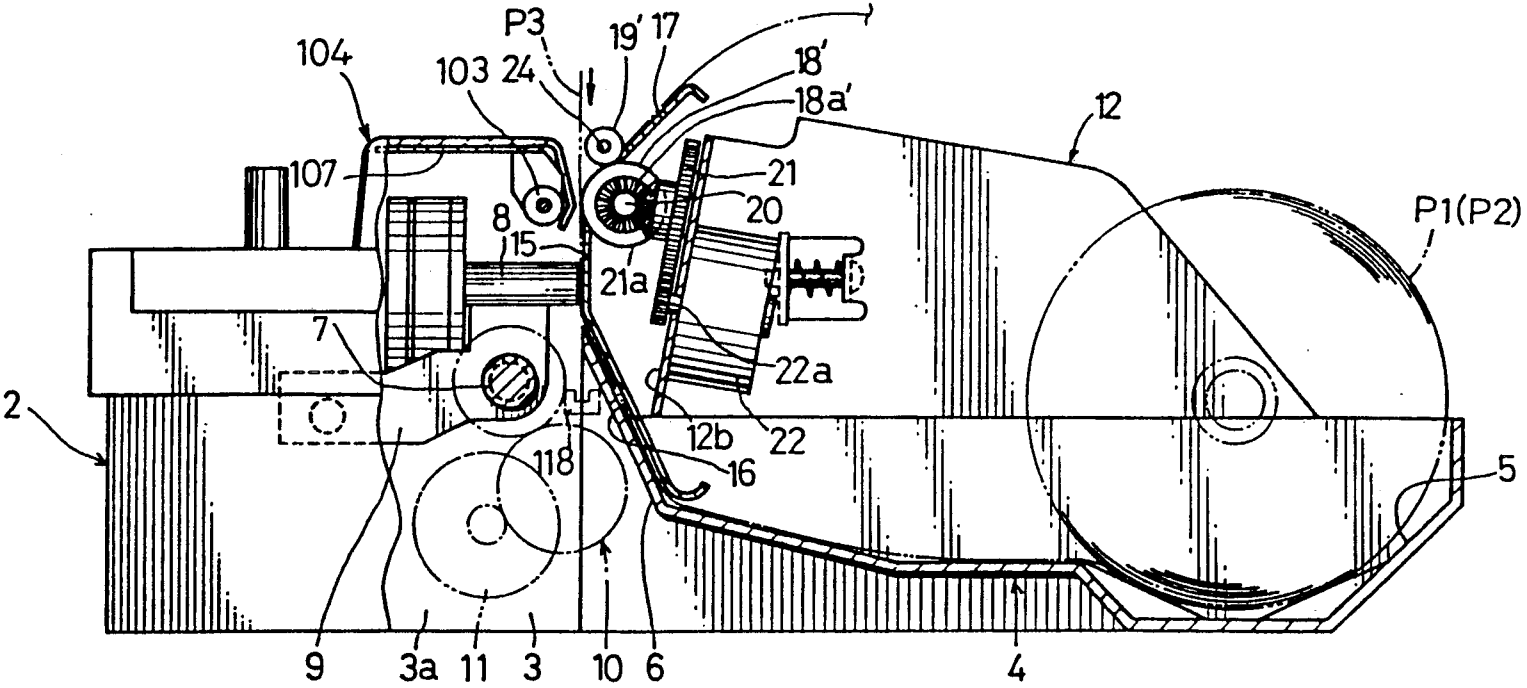
FIG. 23 is a sectional side view of the fourth preferred embodiment.

As shown in FIGS. 20 and 21, the interlocking arm 111 is provided between the slidable plate 107 and the solenoid actuator 109, and is pivotably supported to a pin 112 under the lower surface of the top plate 105b. The interlocking arm 111 is formed at its one end portion with a recess 113 engaging with a pin 114 projecting from the lower surface of the slidable plate 107, and the arm 111 is formed at its other end portion with a connecting portion 111a having a pin 116 engaging with an elongated hole 115 formed at a free end portion of the plunger 109a of the solenoid actuator 109. A spring 117 is provided between the arm 111 and the inside wall of the mounting frame 105, so as to normally bias the arm 111 in such a direction as to retract the slidable plate 107 (in the leftward direction as viewed in FIG. 21) under an off-state of the solenoid actuator 109. Under the condition, the driven roller 103 is separate from the drive roller 18', and as shown in FIG. 23, the cut-sheet paper P3 can be inserted between the drive roller 18' and the driven roller 103 and between the printing head 8 and the platen 15.

There is provided under the printing head 8 in the fixed unit 2 a paper sensor 118 such as a photodetector for photoelectrically detecting the cut-sheet paper P3 when the paper P3 is inserted through the gap between the printing head 8 and the platen 15 to a predetermined position. When the paper sensor 118 detects the cut-sheet paper P3, a detection signal generated from the paper sensor 118 is inputted to a control unit (not shown) in the register. A keyboard (not shown) of the register is provided with a mode selecting switch for selecting a first mode where printing is carried out onto the receipt paper P1 and the journal paper P2 or a second mode where printing is carried out onto the cut-sheet paper P3. When the second mode is selected, the solenoid actuator 109 is excited by an output from the control unit in the register. As a result, the plunger 109a of the solenoid actuator 109 is retracted to rotate the arm 111 against the biasing force of the spring 117 in a forwarding direction of the slidable plate 107. As a result, the driven roller 103 mounted to the slidable plate 107 is brought into contact with the drive roller 18' with the cut-sheet paper P3 interposed therebetween.

When the mode selecting switch is selected to the first mode where printing is carried out onto the receipt paper P1 and the journal paper P2, the solenoid actuator 109 is in the de-excited condition, and accordingly the driven roller 103 is separate from the drive roller 18'. Under the condition, the reversible motor 22 is rotated in opposite directions. When the motor 22 is rotated forwardly, the drive roller 18' is rotated to feed the receipt paper P1, while the drive roller 18 is not rotated since the clutch spring 102 is slipped on the boss of the bevel gear 18a. After a predetermined length of the receipt paper P1 is fed by the drive roller 18' and the driven roller 19', the motor 22 is rotated reversely to rotate the drive roller 18 and feed the journal paper P2, while the drive roller 18' is not rotated since the clutch spring 101 is slipped on the boss of the bevel gear 18a'. Thus, a predetermined length of the journal paper P2 is fed by the drive roller 18 and the driven roller 19.

Upon stoppage of the feed of the receipt paper P1 and the journal paper P2, the printing head 8 is driven by a driving device in the register according to print data to be generated from the print control device, and the same data are printed on the receipt paper P1 and the journal paper P2.

In conducting printing onto the cut-sheet paper P3, the cut-sheet paper P3 is inserted between the drive roller 18' and the driven roller 103 and between the printing head 8 and the platen 15 to the predetermined position. Then, the cut-sheet paper P3 is detected by the paper sensor 118, and the detection signal is generated from the paper sensor 118 to the control unit in the register. Under the condition, when the mode selecting switch is selected to the mode where printing is carried out onto the cut-sheet paper P3, the solenoid actuator 109 is operated. As a result, the plunger 109a is retracted to rotate the arm 111 in the clockwise direction as viewed in FIG. 21 about the pin 112. As a result, the slidable plate 107 is slid on the guides 108 and is forwarded toward the drive roller 18', thereby bringing the driven roller 103 into contact with the drive roller 18' with the cut-sheet paper P3 and the receipt paper P1 interposed therebetween.

Under the condition, the motor 22 is rotated forwardly to thereby feed the cut-sheet paper P3 and the receipt paper P1 as pinched by the drive roller 18' and the driven roller 103. After a predetermined length of the cut-sheet paper P3 and the receipt paper P1 is fed, data are printed on the cut-sheet paper P3 by the printing head 8. In this case, the motor 22 is not rotated reversely, and accordingly the journal paper P2 is neither fed nor printed.

Although the printing head 8 is located in the fixed unit 2, and the platen 15 is located in the movable unit 12 in the previous preferred embodiments, the printing head 8 may be located in the movable unit 12, and the platen 15 may be located in the fixed unit 2.

Having thus described the preferred embodiment of the invention, it should be understood that numerous structural modifications and adaptations may be made without departing from the spirit of the invention.

What is claimed is:

1. A recording apparatus for recording information on both a continuous rolled recording medium and a cut-sheet recording medium, said recording apparatus comprising:

a fixed unit;

a movable unit adapted to be moved relative to said fixed unit between an open position and a closed position, a continuous rolled recording medium being exchangeable in said open position of said movable unit;

a printing head located in either of said fixed unit or said movable unit;

a platen located in the remaining of said fixed unit or said movable unit in such a manner than a gap for permitting insertion of a cut-sheet recording medium is defined between said printing head and said platen when said movable unit is in said closed position; and a pair of feed rollers for feeding said continuous rolled recording medium, said feed rollers comprising a drive roller located in either of said fixed unit or said movable unit and a driven roller located in the remaining of said fixed unit or said movable unit, one of said feed rollers located in said fixed unit being displaceable between a contact position contacting with the other feed roller located in said movable unit when said movable unit is in the closed position and a release position separate from the other feed roller outside a locus of an outer profile of said movable unit, said pair of feed rollers being located at a position apart from an extension of said gap between said printing head and said platen when said movable unit is both in the closed position and the open position, whereby said cut-sheet recording medium can be inserted into said gap without passing between and being hindered by said pair of feed rollers when said movable unit is in the closed position, and without being intersected by a movement of said feed roller located in said fixed unit when said movable unit is displaced between the open and closed positions, and said movable unit can be moved without being hindered by said feed roller located in said fixed unit, and when said movable unit is closed under the condition where one end portion of said continuous rolled recording medium is unrolled and extended along an outer periphery of said feed roller located in said movable unit, said one end portion of said continuous rolled recording medium can be set between said printing head and said platen and between said pair of feed rollers.

2. The recording apparatus as defined in claim 1, wherein said drive roller is located in said movable unit, and said driven roller is located in said fixed unit.

3. The recording apparatus as defined in claim 2 further comprising a motor for driving said drive roller and a torque transmitting mechanism for transmitting a torque of said motor to said drive roller, said motor and said torque transmitting mechanism being located in said movable unit.

4. The recording apparatus as defined in claim 3, wherein said motor comprises a reversible motor, and said drive roller comprises first and second drive rollers, and said driven roller comprises first and second driven rollers adapted to releaseably contact said first and second drive rollers and be rotated, respectively, and said torque transmitting mechanism comprises first and second one-way clutches, said first drive roller being rotatable through said first one-way clutch when said reversible motor is rotated in one direction, while said second drive roller being rotatable through said second one-way clutch when said reversible motor is rotated in the other direction.

5. The recording apparatus as defined in claim 4 further comprising a third driven roller located in said fixed unit in such a manner as to be opposed to at least one of said first and second drive rollers located in said movable unit with a gap permitting insertion of said cut-sheet recording medium being defined between said third driven roller and at least one of said first and second drive rollers, wherein said third driven roller is adapted to contact at least one of said first and second drive rollers.

6. The recording apparatus as defined in claim 5 further comprising a detecting means for detecting insertion of said cut-sheet recording medium into said gap defined between said printing head and said platen, wherein when said detecting means detects that said cut-sheet recording medium is inserted into said gap, said second driven roller is brought into contact with said drive roller.

7. The recording apparatus as defined in claim 1, further comprising a take-up roller for winding said continuous rolled recording medium after printing, said take-up roller being located in said movable unit and being rotatable in opposite directions in association with movement of said movable unit.

8. The recording apparatus as defined in claim 7, further comprising a sector gear formed in said fixed unit and having a center equal to a center of rotation of said movable unit and a gear adapted to be rotated with said take-up roller and meshing with said sector gear, wherein when said movable unit is rotated about its center, said gear meshing with said sector gear is rotated to cause rotation of said take-up roller.

9. The recording apparatus as defined in claim 8, wherein when said movable unit is in the closed position, said gear located in said movable unit is separated from said sector gear formed in said fixed unit.

10. The recording apparatus as defined in claim 1, further comprising a lock lever pivotably mounted to said fixed unit for releasably locking said movable unit, wherein when said lock lever is in an unlock position, said movable unit is displaceable relative to said fixed unit, said lock lever being provided with a cam mechanism to be engaged with said feed roller located in said fixed unit, wherein when said lock lever is in the unlock position, said feed roller located in said fixed unit is positioned outside the locus of the outer profile of said movable unit.

11. The recording apparatus as defined in claim 1, further comprising a detection lever pivotably mounted to said movable unit for detecting a residual amount of said continuous rolled recording medium and a detection switch fixed to said fixed unit and adapted to cooperate with said detection lever, wherein said detection lever is normally biased against an outer circumference of said continuous rolled recording medium and is restrained from its pivotal movement and when a roll diameter of said continuous rolled recording medium corresponding to said residual amount becomes a predetermined value or less, the restrainment of pivotal movement of said detection lever is released to cause contact of said detection lever with said detection switch and turn on said detection switch.

12. The recording apparatus as defined in claim 11, further comprising a lever stopper formed in said fixed unit for stopping rotation of said detection lever, wherein when said movable unit is opened at a certain angle, said detection lever is rotated about the center of rotation of said movable unit and is brought into abutment against said lever stopper, and when said movable unit is further rotated, said detection lever is rotated about an abutment point between same and said lever stopper in such a manner as to be moved away from the continuous rolled recording medium.

13. The recording apparatus as defined in claim 11, wherein a position of the pivotal point of said detection lever is adjustable so as to change a contact position between said detection lever and said detection switch.

* * * * *